US006556182B1

(12) United States Patent
Goto et al.

(10) Patent No.: US 6,556,182 B1
(45) Date of Patent: Apr. 29, 2003

(54) LIQUID CRYSTAL DISPLAY DEVICE HAVING AN IMPROVED VIDEO LINE DRIVER CIRCUIT

(75) Inventors: Mitsuru Goto, Chiba (JP); Yozo Nakayasu, Mobara (JP); Shinji Yasukawa, Chosei (JP); Kentaro Agata, Mobara (JP); Yuji Yamashita, Chiba (JP); Koichi Kotera, Kokubunji (JP)

(73) Assignees: Hitachi, Ltd., Tokyo (JP); Hitachi Device Engineering Co., Ltd., Mobara (JP); Hitachi ULSI Systems Co., Ltd., Tokyo (JP)

( * ) Notice: Subject to any disclaimer, the term of this patent is extended or adjusted under 35 U.S.C. 154(b) by 252 days.

(21) Appl. No.: 09/644,862

(22) Filed: Aug. 24, 2000

(30) Foreign Application Priority Data

Aug. 31, 1999 (JP) ..... 11-244245

(51) Int. Cl.[7] ..... G09G 3/36
(52) U.S. Cl. ..... 345/98; 345/100
(58) Field of Search ..... 345/87, 89, 92, 345/98, 100

(56) References Cited

U.S. PATENT DOCUMENTS 5,675,278 A * 10/1997 Tanaka et al. ..... 323/315
5,854,627 A * 12/1998 Kurihara et al. ..... 345/211
5,936,911 A * 8/1999 Inaba ..... 365/154
6,014,122 A * 1/2000 Hashimoto ..... 345/100

* cited by examiner

*Primary Examiner*—Richard Hjerpe
*Assistant Examiner*—Kevin M. Nguyen
(74) *Attorney, Agent, or Firm*—Antonelli, Terry, Stout & Kraus, LLP

(57) ABSTRACT

A liquid crystal display element having pixels, video signal lines applying a video signal voltage to the pixels and a video signal line driver supplying the video signal voltages to the video signal lines. The video signal line driver circuit includes a gray-scale voltage generating circuit provided with a resistor circuit dividing voltages between plural gray-scale reference voltages to generate plural gray-scale voltages, and selector circuits selecting one gray-scale voltage in accordance with the display data. The resistor circuit includes a resistive element provided with plural Intermediate taps for dividing voltages to generate the gray-scale voltages, gray-scale voltage lines corresponding to the gray-scale voltages, an interlayer insulating film insulating the gray-scale lines from the resistive element, and connections connecting the gray-scale voltage lines to corresponding ones of the intermediate taps through a hole in the interlayer insulating film.

11 Claims, 15 Drawing Sheets

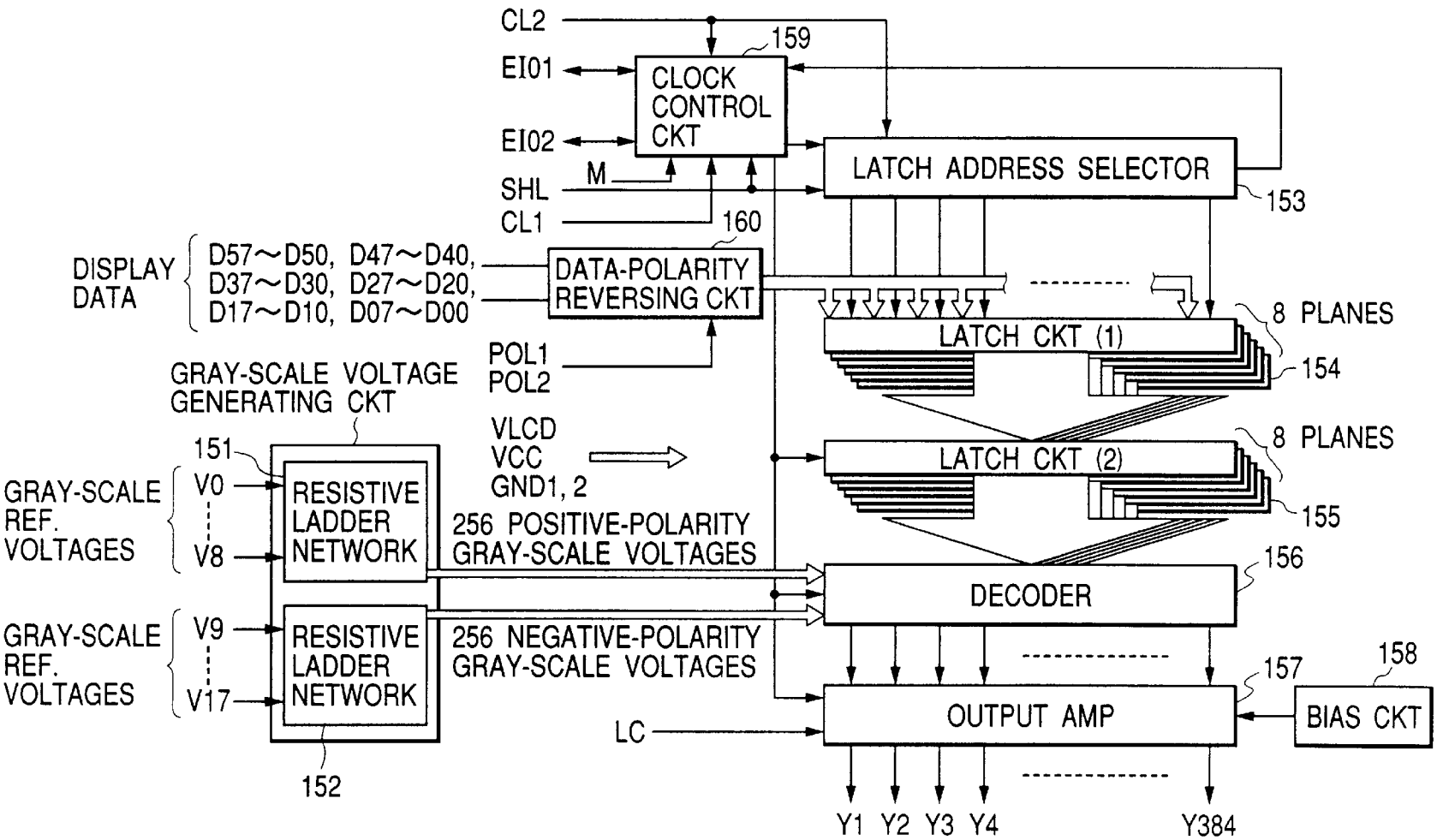
FIG. 5
CLOCK CONTROL CKT
159
LATCH ADDRESS SELECTOR
153
8 PLANES
154
LATCH CKT (1)
8 PLANES
155
LATCH CKT (2)
156
DECODER
157
OUTPUT AMP
158
BIAS CKT
Y384
Y1 Y2 Y3 Y4
CL2
EI01
EI02
M
SHL
CL1
160
DATA-POLARITY REVERSING CKT
POL1
POL2
VLCD
VCC
GND1, 2
256 POSITIVE-POLARITY GRAY-SCALE VOLTAGES
256 NEGATIVE-POLARITY GRAY-SCALE VOLTAGES
LC
D57~D50, D47~D40,
D37~D30, D27~D20,
D17~D10, D07~D00
DISPLAY DATA
GRAY-SCALE VOLTAGE GENERATING CKT
151
RESISTIVE LADDER NETWORK
RESISTIVE LADDER NETWORK
152
V0
V8
V9
V17
GRAY-SCALE REF. VOLTAGES
GRAY-SCALE REF. VOLTAGES

LIQUID CRYSTAL DISPLAY DEVICE HAVING AN IMPROVED VIDEO LINE DRIVER CIRCUIT

BACKGROUND OF THE INVENTION

The present invention relates to a liquid crystal display device used for a personal computer, a work station or the like, and in particular to a technique useful for a video signal line driver circuit (a drain driver) in a liquid crystal display device capable of a multi-gray scale display.

Active matrix type liquid crystal display devices which have an active element (a thin film transistor, for example) for each pixel and switch the active elements are widely used as display devices for notebook personal computers and the like. In the active matrix type liquid crystal display device, each pixel electrode is supplied with a video signal voltage (a gray-scale voltage) via an active element, no cross talk between pixels occur, and therefore a multi-gray scale display is produced without the need for a special driving scheme for prevention of the cross talk, unlike a liquid crystal display device of the so-called simple matrix type.

As one of the active matrix type liquid crystal display devices, there is known a TFT (Thin Film Transistor) type liquid crystal display module having a TFT type liquid crystal display panel (a TFT-LCD), drain drivers disposed at the top side of the liquid crystal display panel and gate drivers disposed at the lateral side of the liquid crystal display panel.

The TFT type liquid crystal display module includes, in its drain drivers, a gray-scale voltage generating circuit for generating a plurality of gray-scale voltages, decoders for selecting a gray-scale voltage in accordance with a display data from among the plurality of gray-scale voltages generated by the gray-scale voltage generating circuit, amplifiers for amplifying the gray-scale voltage selected by the decoders so as to output a video signal voltage in accordance with the display data to a corresponding one of drain signal lines, and a bias circuit for controlling a current of a constant current source in the amplifiers. Such a technique is disclosed in Japanese Patent Application No. Hei 11-47885 (filed on Feb. 25, 1999, but not laid-open on the filing date of the present application), for example.

SUMMARY OF THE INVENTION

The gray-scale voltage generating circuit in the drain driver includes a voltage-dividing resistor circuit for dividing voltages between a plurality of gray-scale reference voltages supplied from a power supply circuit so as to generate a plurality of gray-scale voltages.

Each of the drain drivers is formed in one semiconductor integrated circuit (a semiconductor chip), and the voltage-dividing resistor circuit is formed of a tapped resistive element, a plurality of gray-scale voltage lines for outputting gray-scale voltages, an interlayer insulating film for insulating the gray-scale voltage lines from the tapped resistive element, and a plurality of connections for connecting the gray-scale voltage lines with the taps of the tapped resistive element via contact holes formed in the interlayer insulating film.

A resistance of the resistive element between two adjacent taps of the resistive element is determined by (a length of the resistive element between the two taps of the resistive element)/(a width W of the resistive element)×(a sheet resistance of the resistive element).

In conventional drain drivers, the above-mentioned connections for connecting the gray-scale voltage lines-with the taps of the tapped resistive element are disposed in a current path of a current flowing through the resistive element. In this case, the length L of the resistive element between the two adjacent taps varies with manufacturing variability of dimensions of the contact holes or the like, and consequently, a problem arises in that the resistance of the resistive element between two adjacent taps varies such that a gray-scale voltage generated in the voltage-dividing resistor circuit varies and the quality of a display image by the liquid crystal display panel is degraded.

The area of the contact holes had to be made small because the contact holes are disposed in a current path of a current flowing through the resistive element and therefore the area of the contact holes is limited. As a result, there has been a problem that the resistance at the connections for connecting the gray-scale voltage lines with the taps of the resistive element is increased and time delay is caused in transfer characteristics of gray-scale voltages from the voltage-dividing resistor circuit to a succeeding amplifier.

Recently, there are demands for a larger-sized display panel (a larger-sized TFT-LCD), higher resolution, a higher-quality display image and lower power consumption on the TFT active matrix type liquid crystal display device, and also there is a demand for reduction of power consumption on the liquid crystal display devices because necessity for their long-period operation powered by batteries is becoming greater as notebook personal computers spread.

In this case, for the purpose of improving the quality of a display image, the greater the voltage range of gray-scale voltages applied across the liquid crystal layer, that is, the voltage range of output voltages outputted from the drain drivers, the better for improvement of response speed of the liquid crystal and display contrast. In view of this, the power supply voltage VDD for the drain drivers is selected to be high.

In general, each of the amplifiers of the drain drivers comprises a high-voltage amplifier for amplifying positive-polarity gray-scale voltages and a low-voltage amplifier for amplifying negative-polarity gray-scale voltages. These high-voltage and low-voltage amplifiers are formed by differential amplifiers and current values of constant-current sources each for a respective one of the differential amplifiers are determined by one bias circuit. The bias circuit had to be formed by high-breakdown-voltage MOS transistors (hereinafter referred to merely as high-voltage MOS transistors) because the power supply voltage VDD for the drain drivers is high.

Generally, in the high-voltage MOS transistors, the thickness of the gate insulator oxide is made thick enough to ensure a high breakdown voltage (a high withstand voltage) and a region for relaxing electric fields is necessary, and consequently, variations in threshold voltages and the like of high-voltage MOS transistors are greater than those of low-breakdown-voltage MOS transistors (hereinafter referred to merely as low-voltage MOS transistors). As a result, current values of the currents supplied from the bias circuits to the constant-current sources of the differential amplifiers forming the amplifiers of the drain drivers vary from drain driver to drain driver, and in the liquid crystal panel incorporating about ten drain drivers there is a problem that there is a possibility that display brightness varies from drain driver to drain driver and the quality of a display of the liquid crystal display panel is degraded.

The present invention solves the above-mentioned problems with the prior art, and it is an object of the present invention to provide a technique for improving the quality of a display image of the liquid crystal display panel in the liquid crystal display device.

It is another object of the present invention to provide a technique for preventing occurrence of variations in respective gray-scale voltages generated by gray-scale voltage generating circuits in the liquid crystal display device.

It is yet another object of the present invention to provide a technique for making uniform the current values of the currents of the constant-current sources of the amplifiers of the drain drivers in each of the drain drivers by making it possible to use low-voltage MOS transistors in the bias circuits, in the liquid crystal display device.

The above objects and novel features of the present invention will be apparent from the description of this specification and the accompanying drawings.

The following explains a summary of representative configurations of the present invention.

To accomplish the above objects, in accordance with an embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltages to the plurality of video signal lines, the video signal line driver circuit including a gray-scale voltage generating circuit provided with a voltage-dividing resistor circuit for dividing voltages between a plurality of gray-scale reference voltages supplied from an external power supply circuit so as to generate a plurality of gray-scale voltages, a plurality of selector circuits corresponding to the plurality of video signal lines for selecting one gray-scale voltage from among the plurality of gray-scale voltages in accordance with the display data, the voltage-dividing resistor circuit including a resistive element provided with a plurality of intermediate taps for dividing voltages between the plurality of gray-scale reference voltages so as to generate the plurality of gray-scale voltages, a plurality of gray-scale voltage lines corresponding to the plurality of gray-scale voltages, an interlayer insulating film for insulating the plurality of gray-scale lines from the resistive element, and a plurality of connections for electrically connecting each of the plurality of gray-scale voltage lines to a corresponding one of the plurality of intermediate taps through a hole formed in the interlayer insulating film, the plurality of connections being disposed at positions displaced from a current path of a current flowing in the resistive element.

To accomplish the above objects, in accordance with another embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltages to the plurality of video signal lines, the video signal line driver circuit including a gray-scale voltage generating circuit provided with a voltage-dividing resistor circuit for dividing voltages between a plurality of gray-scale reference voltages supplied from an external power supply circuit so as to generate a plurality of gray-scale voltages, a plurality of selector circuits corresponding to the plurality of video signal lines for selecting one gray-scale voltage from among the plurality of gray-scale voltages in accordance with the display data, the voltage-dividing resistor circuit including a resistive element provided with a plurality of intermediate taps for dividing voltages between the plurality of gray-scale reference voltages so as to generate the plurality of gray-scale voltages, a plurality of gray-scale voltage lines corresponding to the plurality of gray-scale voltages, an interlayer insulating film for insulating the plurality of gray-scale lines from the resistive element, and a plurality of connections for electrically connecting each of the plurality of gray-scale voltage lines to a corresponding one of the plurality of intermediate taps through a hole formed in the interlayer insulating film, each of the plurality of intermediate taps forming a portion protruding in a direction of extension of the plurality of gray-scale voltage lines, from the resistive element and each of the plurality of connections being disposed on the protruding portion.

To accomplish the above objects, in accordance with another embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltage to the plurality of video signal lines, the video signal line driver circuit including a plurality of amplifiers corresponding to the plurality of video signal lines, each of the plurality of amplifiers outputting the video signal voltage to a corresponding one of the plurality of video signal lines, and a bias circuit including a current mirror circuit for controlling a current in a constant-current source in each of the plurality of amplifiers, the current mirror circuit including, between a first power supply voltage line supplied with a first reference power supply voltage and a second power supply voltage line supplied with a second reference power supply voltage, a first transistor element of a first conductivity type and having a low breakdown voltage, a second transistor element of a second conductivity type and having a breakdown voltage higher than the low breakdown voltage, the second transistor element being connected in series with the first transistor element, and at least one third transistor element of the first conductivity type, the at least one third transistor element being connected between the first transistor element and the second transistor element and having a fixed bias voltage applied to a control electrode thereof, the fixed bias voltage being between the first and second reference power supply voltages.

To accomplish the above objects, in accordance with another embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltage to the plurality of video signal lines, the video signal line driver circuit including a plurality of amplifiers corresponding to the plurality of video signal lines, each of the plurality of amplifiers outputting the video signal voltage to a corresponding one of the plurality of video signal lines, and a bias circuit including a current mirror circuit for controlling a current in a constant-current source in each of the plurality of amplifiers, the current mirror circuit including, between a first power supply voltage line supplied with a first reference power supply voltage and a second power supply voltage line supplied with a second reference power supply voltage, a first transistor element of a first conductivity type and having a low breakdown voltage, a second transistor element of a second conductivity type and having a breakdown voltage higher than the low breakdown voltage, the second transistor element being connected in series with the first transistor element, and at least one third transistor element of the first conductivity type, the at least one third transistor element being connected between the first transistor element and the second transistor element and having a control electrode thereof connected to a terminal thereof connected to the second transistor element.

To accomplish the above objects, in accordance with another embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltage to the plurality of video signal lines, the video signal line driver circuit including a plurality of amplifiers corresponding to the plurality of video signal lines, each of the plurality of amplifiers outputting the video signal voltage to a corresponding one of the plurality of video signal lines, and a bias circuit for controlling a current in a constant-current source in each of the plurality of amplifiers, the bias circuit including (a) a first series combination comprising: a first transistor element of a first conductivity type and having a first low breakdown voltage; a second transistor element of a second conductivity type and having a breakdown voltage higher than the first low breakdown voltage, the second transistor element being connected in series with the first transistor element; and at least one third transistor element of the first conductivity type and having a breakdown voltage higher than the first low breakdown voltage, the at least one third transistor element being connected between the first transistor element and the second transistor element; a terminal of the second transistor element connected to the at least one third transistor element being connected to a control electrode of the second transistor element, and a control electrode of the first transistor element being supplied with a bias voltage; (b) a second series combination comprising: a fourth transistor element of the first conductivity type and having a second low breakdown voltage; a fifth transistor element of the second conductivity type and having a breakdown voltage higher than the second low breakdown voltage, the fifth transistor element being connected in series with the fourth transistor element; and at least one sixth transistor element of the first conductivity type and having a breakdown voltage higher than the second low breakdown voltage, the at least one sixth transistor element being connected between the fourth transistor element and the fifth transistors element; a control electrode of the fifth transistor element being connected to the control electrode of the second transistor element, a terminal of the fourth transistor element connected to the at least one sixth transistor element being connected to a control electrode of the fourth transistor element, and a control electrode of the fourth transistor element being configured so as to provide an output; wherein a parallel combination of the first series combination and the second series combination is connected between a first power supply voltage line supplied with a first reference power supply voltage and a second power supply voltage line supplied with a second reference power supply voltage, and a voltage intermediate between the first and second reference power supply voltages is applied to control electrodes of the at least one third transistor element and the at least one sixth transistor element.

To accomplish the above objects, in accordance with another embodiment of the present invention, there is provided a liquid crystal display device comprising a liquid crystal display element having a plurality of pixels arranged in a matrix and a plurality of video signal lines for applying a video signal voltage to each of the plurality of pixels in accordance with a display data, and a video signal line driver circuit for supplying the video signal voltage to the plurality of video signal lines, the video signal line driver circuit including a plurality of amplifiers corresponding to the plurality of video signal lines, each of the plurality of amplifiers outputting the video signal voltage to a corresponding one of the plurality of video signal lines, and a bias circuit for controlling a current in a constant-current source in each of the plurality of amplifiers, the bias circuit including (a) a first series combination comprising: a first transistor element of a first conductivity type and having a first low breakdown voltage; a second transistor element of a second conductivity type and having a breakdown voltage higher than the first low breakdown voltage, the second transistor element being connected in series with the first transistor element; and at least one third transistor element of the first conductivity type and having a breakdown voltage higher than the first low breakdown voltage, the at least one third transistor element being connected between the first transistor element and the second transistor element; a terminal of the second transistor element connected to the at least one third transistor element being connected to a control electrode of the second transistor element, and a control electrode of the first transistor element being supplied with a bias voltage; (b) a second series combination comprising: a fourth transistor element of the first conductivity type and having a second low breakdown voltage; a fifth transistor element of the second conductivity type and having a breakdown voltage higher than the second low breakdown voltage, the fifth transistor element being connected in series with the fourth transistor element; and at least one sixth transistor element of the first conductivity type and having a breakdown voltage higher than the second low breakdown voltage, the at least one sixth transistor element being connected between the fourth transistor element and the fifth transistor element; a control electrode of the fifth transistor element being connected to the control electrode of the second transistor element, a terminal of the fourth transistor element connected to the at least one sixth transistor element being connected to a control electrode of the fourth transistor element, and a control electrode of the fourth transistor element being configured so as to provide an output; wherein a parallel combination of the first series combination and the second series combination is connected between a first power supply voltage line supplied with a first reference power supply voltage and a second power supply voltage line supplied with a second reference power supply voltage, a control electrode of the at least one third transistor element is connected to a terminal of the at least one third transistor element connected to the second transistor element, and a control electrode of the at least one sixth transistor element is connected to a terminal of the at least one sixth transistor element connected to the fifth transistor element.

BRIEF DESCRIPTION OF THE DRAWINGS

In the accompanying drawings, in which like reference numerals designate similar components throughout the figures, and in which:

FIG. 5 is a schematic block diagram of a configuration of an example of drain drivers shown in FIG. 1;

DETAILED DESCRIPTION OF THE PREFERRED EMBODIMENTS

Figure 1:
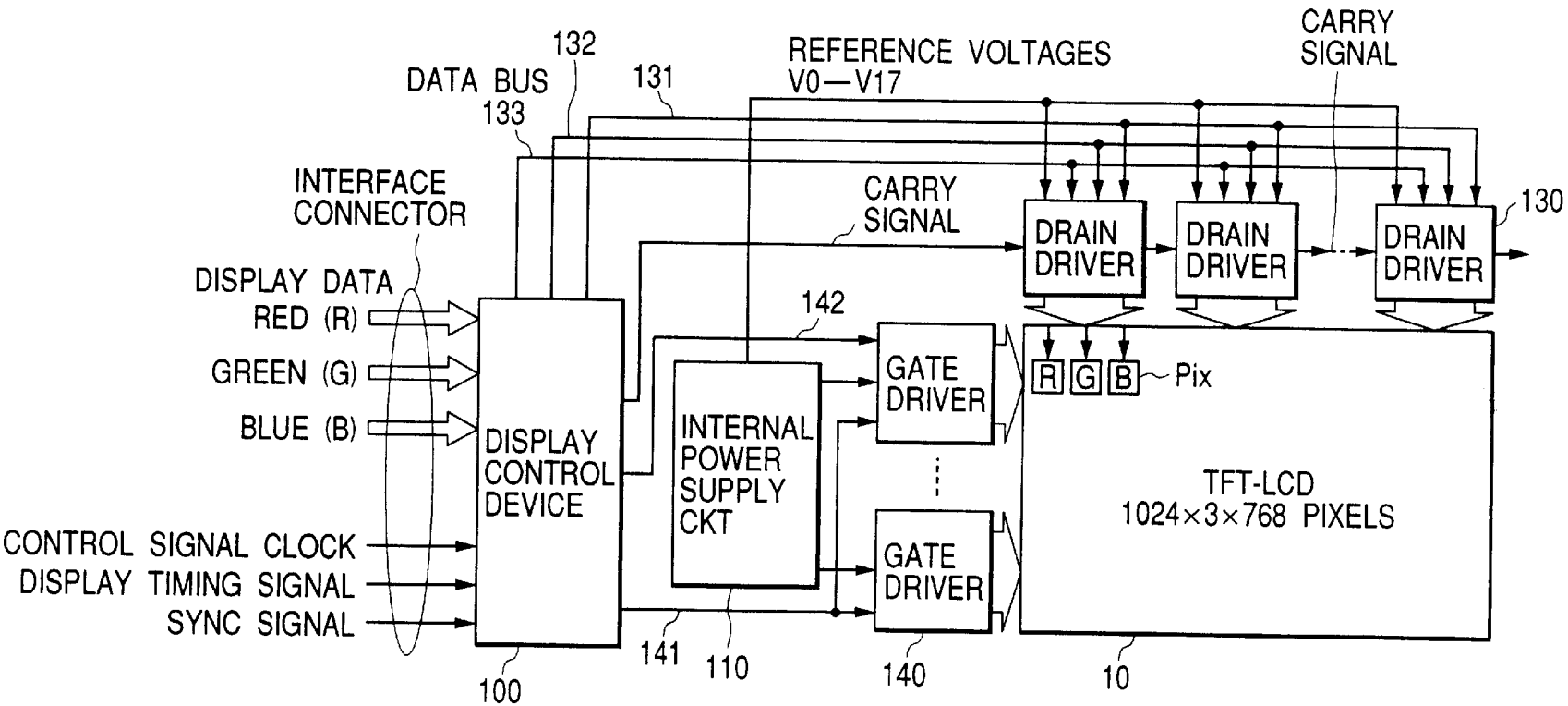
FIG. 1 is a schematic block diagram of a configuration of a TFT type liquid crystal display module in accordance with an embodiment of the present invention.

The embodiments of the present invention will be explained with reference to the drawings. The same reference numerals or characters designate functionally similar parts or portions throughout the figures, and repetition of their explanations is omitted.

FIG. 1 is a schematic block diagram of a configuration of a TFT type liquid crystal display module in accordance with an embodiment of the present invention. In the liquid crystal display module (LCM) of this embodiment, drain drivers 130 are disposed at the top side of a liquid crystal display panel (TFT-LCD) 10, and gate drivers 140, a display control device 100 and an internal power supply circuit 110 are disposed at the lateral side of the liquid crystal display panel 10.

Figure 2:
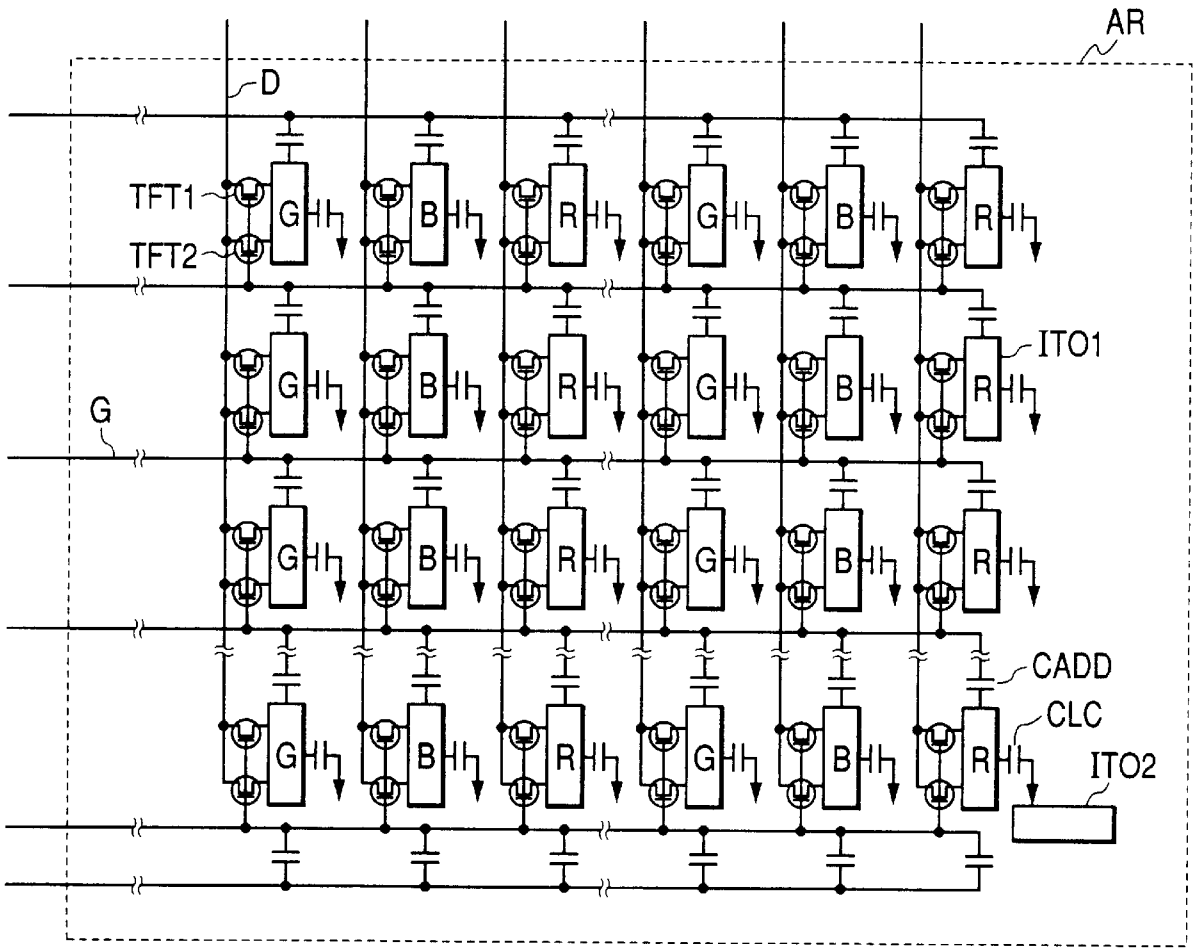
FIG. 2 is an illustration of an equivalent circuit of an example of a liquid crystal display panel shown in FIG. 1.

FIG. 2 is an illustration of an equivalent circuit of an example of the liquid crystal display panel 10 shown in FIG. 1. Although FIG. 2 illustrates a circuit configuration, FIG. 2 represent an actual geometrical arrangement of the components of the liquid crystal display panel 10, and as is shown in FIG. 2, the liquid crystal display panel 10 has a plurality of pixels arranged in a matrix.

Each pixel is disposed in an area surrounded by two adjacent drain signal lines (also referred to video signal lines or vertical signal lines) D and two adjacent gate signal lines (also referred to as scanning signal lines or horizontal signal lines) G. Each pixel is provided with a pair of thin film transistors (TFT1 and TFT2), source electrodes of the thin film transistors TFT1, TFT2 of each pixel are connected to a pixel electrode ITO1, a liquid crystal layer LC is sandwiched between the pixel electrode ITO1 and a common electrode (ITO2), and consequently a liquid crystal capacitance is connected between the source electrodes of the thin film transistors (TFT1, TFT2) and the common electrode ITO2 in the equivalent circuit. Further, a so-called "additional capacitance" (CADD) is connected between the source electrodes of the thin film transistors (TFT1, TFT2) and a gate signal line (G) immediately preceding a gate line (G) associated with the thin film transistors (TFT1, TFT2).

Figure 3:
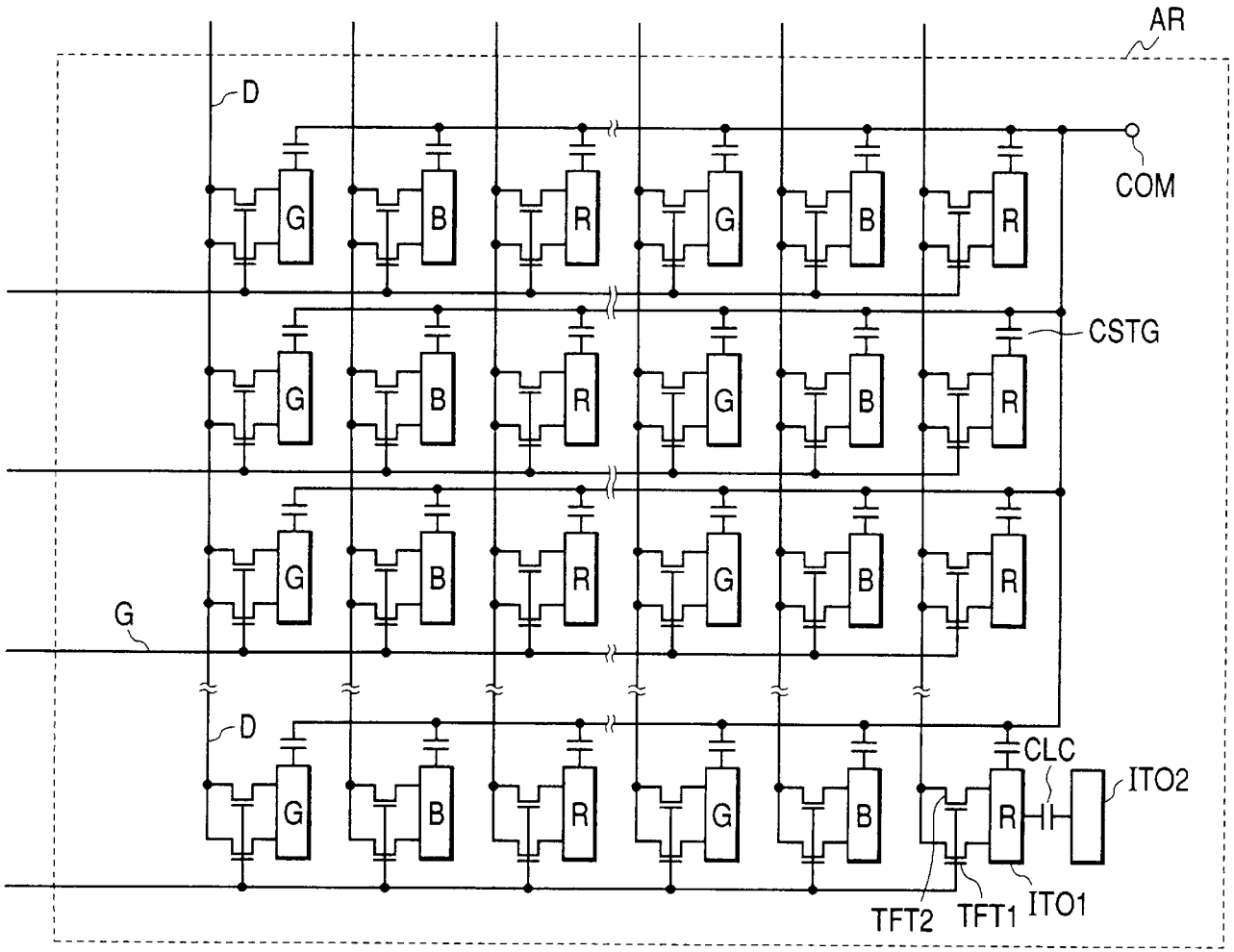
FIG. 3 is an illustration of an equivalent circuit of another example of a liquid crystal display panel shown in FIG. 1.

FIG. 3 is an illustration of an equivalent circuit of another example of the liquid crystal display panel 10 shown in FIG. 1. In the example of FIG. 2, the additional capacitance (CADD) is formed between the source electrodes and the gate signal line (G) immediately preceding the source electrodes, but the equivalent circuit of the example of FIG. 3 differs from that of FIG. 2 in that a so-called storage capacitance (CSTG) is formed between the source electrodes and a common signal line (COM).

The present invention is applicable to both the examples of FIGS. 2 and 3. In the example of FIG. 2, a pulse applied to the gate signal line (G) immediately preceding the source electrodes is introduced into the pixel electrode (ITO1) via the additional capacitance (CADD), but in the example of FIG. 3 the pulse is not introduced into the pixel electrode (ITO1) and therefore a better display image is produced. In FIGS. 2 and 3, a symbol AR denotes a display area.

In the liquid crystal display panel 10 of FIG. 2 or 3, drain electrodes of the thin film transistors (TFT1, TFT2) of pixels arranged in a column is connected to a same drain signal line (D) which in turn is connected to a corresponding one of the drain drivers 130 for applying a video signal voltage (a gray-scale voltage) in accordance with a display data across a liquid crystal layer of the pixels arranged in the column, and gate electrodes of the thin film transistors (TFT1, TFT2) of pixels arranged in a row is connected to a same gate signal line (G) which in turn is connected to a corresponding one of the gate drivers 140 for supplying a scanning drive voltage (a positive or negative bias voltage) during one horizontal scanning period to the gate electrodes of the thin film transistors (TFT1, TFT2) arranged in the row. The liquid crystal display panel 10 shown in FIG. 1 has 1024×3×768 pixels.

The display control device 100 shown in FIG. 1 is formed in one semiconductor integrated circuit (LSI), and controls and drives the drain drivers 130 and the gate drivers 140 based upon display control signals such as a clock signal, a display timing signal, a horizontal sync signal, a vertical sync signal, and display data (R, G, B) transferred from a host computer.

The display control device 100 judges the display timing signal as a display start position when it is inputted, and outputs the supplied display data to the drain drivers 130 via a bus line 133 for the display data. At that time, the display control device 100 outputs a display data latch clock (CLK2) as a display control signal for latching the display data in data latch circuits of the drain drivers 130, to the drain drivers 130 via a signal line 131. Each display data consists of 24 bits with 8 bits for each primary color.

The display control device 100 judges that display data corresponding to a horizontal scanning line has been supplied when the display timing signal has ended or when a predetermined length of time has elapsed after the display timing signal is inputted, and then outputs an output timing control clock (CLK1) to the drain drivers 130 via a signal line 132 as a display control signal for outputting gray-scale voltages corresponding to the display data stored in the latch circuits of the drain drivers 130 to the drain signal lines (D) (see FIGS. 2 and 3) of the liquid crystal display panel 10.

Further, the display control device 100 judges the first display timing signal after a vertical sync signal to be the first display line, and then outputs a frame start signal to a first one of the gate drivers 140 via a signal line 142.

Further, the display control device 100 outputs shift clocks (CLK3) with a horizontal scanning period to the gate drivers 140 based upon the horizontal sync signals via a signal line 141 such that the gate drivers 140 apply positive bias voltages to gate signal lines (G) of the liquid crystal display panel 10 sequentially with a horizontal sync period.

With this configuration, a pair of thin film transistors (TFT1, TFT2) connected to each of the gate signal lines (G) of the liquid crystal display panel 10 are made conducting during a horizontal scanning time such that an image is produced on the liquid crystal display panel 10.

Figure 4:
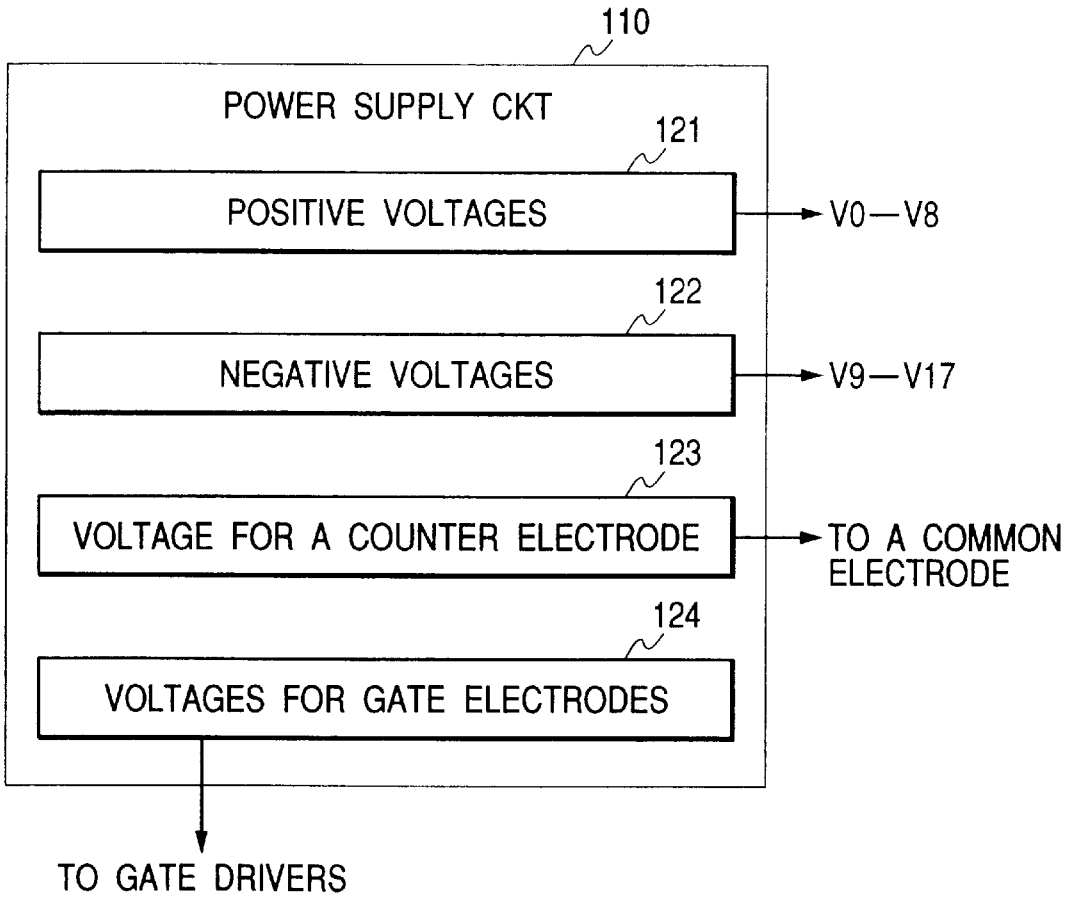
FIG. 4 is a schematic block diagram of a configuration of an internal power supply circuit shown in FIG. 1.

FIG. 4 is a schematic block diagram of a configuration of an internal power supply circuit 110*n* in FIG. 1. As shown in FIG. 4, the internal power supply circuit 110 comprises a positive voltage generating circuit 121, a negative voltage generating circuit 122, a common-electrode (counter-electrode) voltage generating circuit 123, and a gate electrode voltage generating circuit 124.

The positive voltage generating circuit 121 and the negative voltage generating circuit 122 are voltage-dividing circuits formed of series-connected resistors for outputting nine positive gray-scale reference voltages (V0 to V8) and nine negative gray-scale reference voltages (V9 to V17), respectively. These nine positive gray-scale reference voltages (V0 to V8) and nine negative gray-scale reference voltages (V9 to V17) are supplied to each of the drain drivers 130.

The common-electrode voltage generating circuit 123 generates a drive voltage applied to the common electrode (ITO2), and the gate electrode voltage generating circuit 124 generates drive voltages (positive and negative bias voltages) applied to the gate electrodes of the thin film transistors (TFT1, TFT2).

Further, each of the drain drivers 130 is supplied with a control signal for AC driving (a timing signal for AC driving, M), but this is omitted in FIG. 1.

Generally, when a fixed voltage (a direct current voltage) is applied across a liquid crystal layer (LC) for a long period of time, tilting of liquid crystal molecules is fixed, and as a result, image retention is caused and life of the liquid crystal layer (LC) is shortened.

In order to prevent this, in a prior art liquid crystal display device, the polarity of voltages applied across the liquid crystal layer (LC) is reversed periodically, that is to say, liquid crystal drive voltages applied to pixel electrodes (ITO1) are made alternately positive and negative with respect to a liquid crystal drive voltage applied to a common electrode (ITO2) periodically.

As driving methods for applying alternating voltages across the liquid crystal layer (LC), there are known two methods, a fixed common-electrode voltage method and a common-electrode voltage inversion method. The common-electrode voltage inversion method reverses polarities of both voltages applied to the common electrode (ITO2) and the pixel electrodes (ITO1) periodically. On the other hand, the fixed common-electrode voltage method makes voltages applied to the pixel electrodes (ITO1) alternately positive and negative with respect to a fixed voltage applied to the common electrode (ITO2) periodically.

Although the fixed common-electrode voltage method has a disadvantage that the amplitudes of voltages applied to the pixel electrodes (ITO1) are twice as much as those with the common-electrode voltage inversion method and therefore low-breakdown-voltage drivers cannot be used, this method can be applied to a dot-inversion drive method or a column-inversion drive method which is excellent in terms of low power consumption and display quality.

When the dot-inversion drive method is used for the liquid crystal display module, the polarities of the voltages applied to two adjacent drain signal lines (D), respectively, are opposite from each other, and accordingly, currents flowing into the common electrode (ITO2) and gate electrodes (G) associated with two adjacent drain-signal lines cancel out each other such that power consumption can be reduced. Further, currents flowing in the common electrode (ITO2) are small and voltage drop is limited, and therefore the voltage level of the common electrode (ITO2) is stable and deterioration of display quality can be minimized.

FIG. 5 is a schematic block diagram of a configuration of an example of the drain drivers 130 shown in FIG. 1, and one drain driver 130 is formed in one semiconductor integrated circuit (a semiconductor chip).

In FIG. 5, a positive-polarity gray scale voltage generating circuit 151 generates 256 positive-polarity gray scale voltages based on 9 positive-polarity gray scale reference voltages (V0 to V8) inputted from the positive voltage generating circuit 121 (see FIG. 4) and outputs them to a decoder 156.

A negative-polarity gray scale voltage generating circuit 152 generates 256 negative-polarity gray scale voltages based on 9 negative-polarity gray scale reference voltages (V9 to V17) inputted from the negative voltage generating circuit 122 and outputs them to the decoder 156.

A latch address selector 153 of the drain-driver 130 generates a data input control signal for a latch circuit (1) 154 based on the display data latch clock (CLK2) inputted from the display control device 100 and outputs it to the latch circuit (1) 154.

The latch circuit (1) 154 latches display data consisting of 8 bits for each primary color based on the data input control signal outputted from the latch address selector 153 in synchronism with the display data latch clock (CLK2) inputted from the display control device 100, the number of the latched display data corresponding to the number of outputs from the drain driver 130.

A latch circuit (2) 155 latches the display data in the latch circuit (1) 154 in accordance with the output timing control clock (CLK1) inputted from the display control device 100.

Then the display data latched in the latch circuit (2) 155 are inputted to the decoder 156 via a level shift circuit.

The decoder 156 selects one gray scale voltage in accordance with a display data from among the 256 positive-polarity gray-scale voltages or the 256 negative-polarity gray-scale voltages and outputs it to an output amplifier 157.

The output amplifier 157 current-amplifies and outputs the inputted gray-scale voltage to a corresponding one of the drain signal lines D (see FIGS. 2 and 3) (which correspond to Y1, Y2, . . . , Y384 in FIG. 5).

In FIG. 5, a bias circuit 158 determines a current value of a constant-current source in the output amplifier 157. A clock control circuit 159 generates start pulses (EIO1, EIO2) and a internal timing signal.

A data-polarity reversing circuit 160 reverses the polarity of inputted display data or not according to whether gray-scale voltages applied to the drain signal lines (D) are of positive polarity or negative polarity, respectively, that is, whether an inputted signal is POL1 or POL2, respectively.

Figure 6:
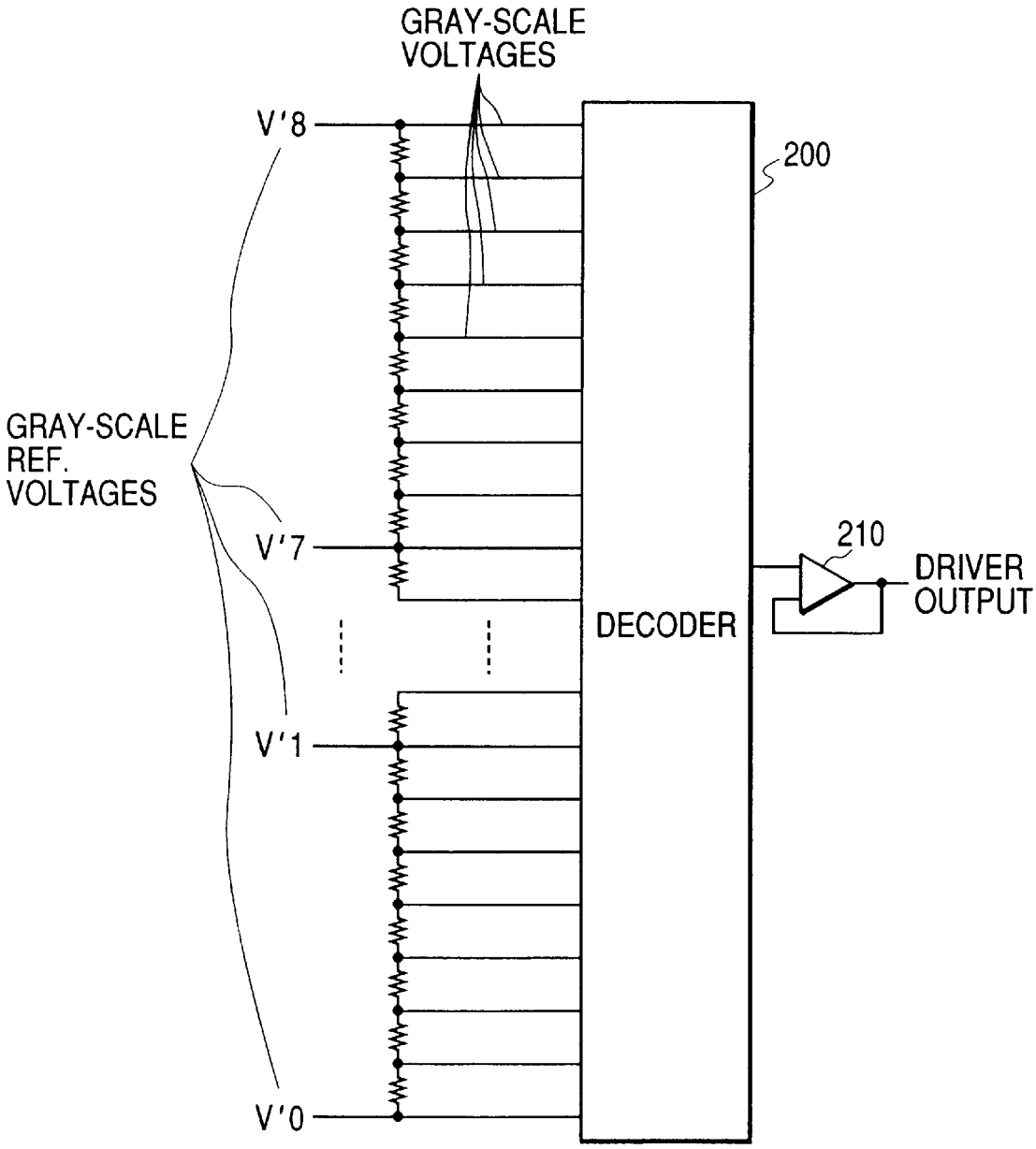
FIG. 6 is an illustration of a circuit configuration of a positive-polarity or negative-polarity gray-scale voltage generating circuit shown in FIG. 5.

FIG. 6 is an illustration of a circuit configuration of the positive-polarity gray-scale voltage generating circuit 151 and the negative-polarity gray-scale voltage generating circuit 152 shown in FIG. 5. In FIG. 6, symbols V'0 to V'8 represent nine positive-polarity gray-scale reference voltages V0 to V8 or nine negative-polarity gray-scale reference voltages V9 to V17.

As shown in FIG. 6, the gray-scale voltage generating circuit is a voltage-dividing resistor circuit which divides a voltage between two successive gray-scale reference voltages among the nine positive-polarity gray-scale reference voltages V0 to V8 or nine negative-polarity gray-scale reference voltages V9 to V17, by using resistor elements so as to produce 256 gray-scale voltages of positive-polarity or negative-polarity. In this case, a resistance value of each of the resistor elements connected between two successive gray-scale reference voltages is weighted by such a factor as to reflect a relationship between a voltage applied across the liquid crystal layer and a light transmission through the liquid crystal layer.

Figure 7:
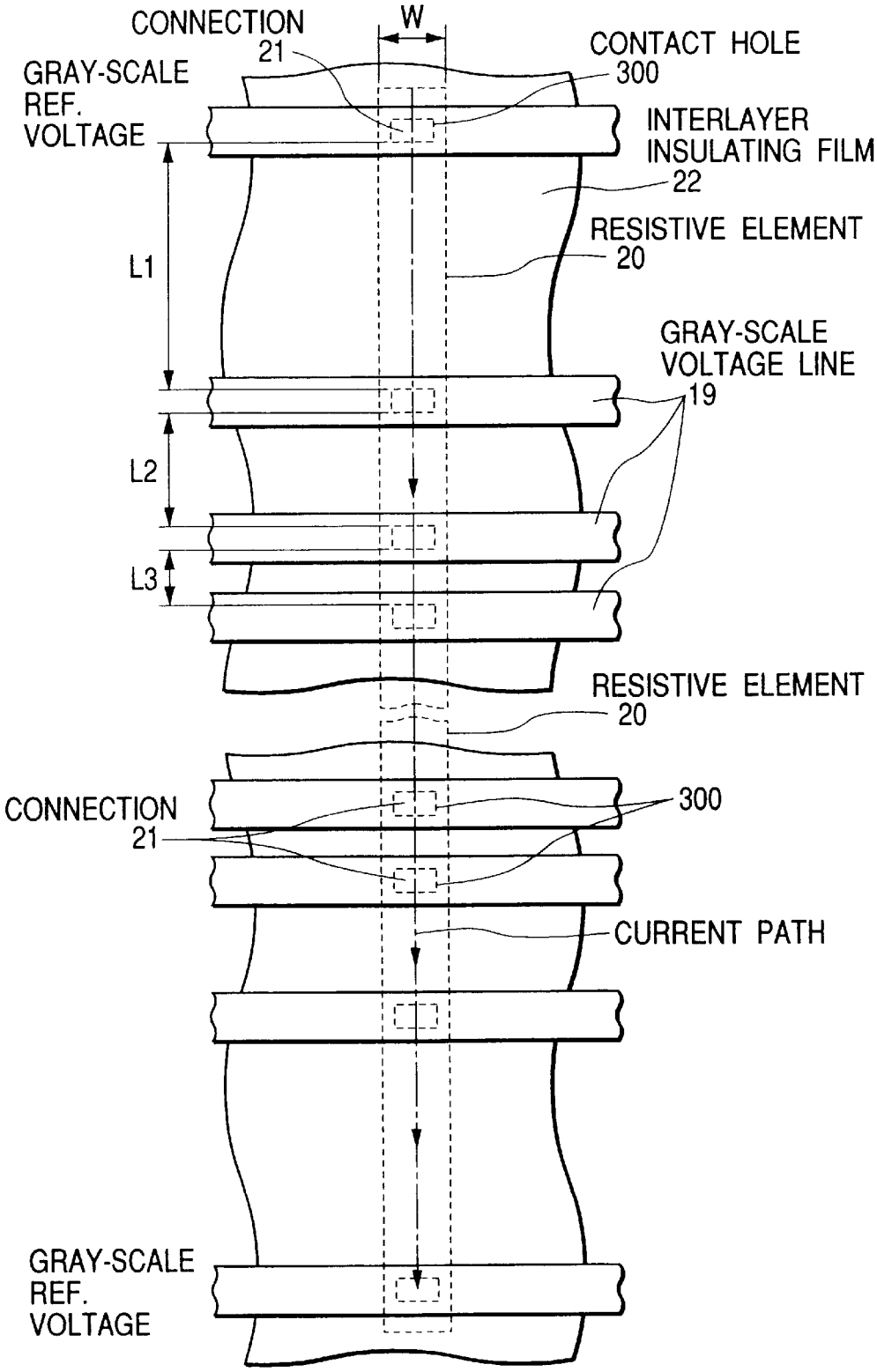
FIG. 7 PRIOR ART
FIG. 7 is a fragmentary plan view illustrating a layout of a prior art gray-scale voltage generating circuit within a semiconductor integrated circuit (a semiconductor chip)

FIG. 7 is a fragmentary plan view illustrating a layout of a prior art gray-scale voltage generating circuit within a semiconductor integrated circuit (a semiconductor chip). The prior art gray-scale voltage generating circuit comprises a plurality of gray-scale voltage lines 19 made of aluminum or the like, a resistive element 20 made of a diffused resistive film or the like and disposed below the gray-scale voltage lines 19 with an interlayer insulating film 22 interposed therebetween, and a plurality of connections 21 for connecting the gray-scale voltage lines 19 to the resistive element 20 via contact holes 300 formed in the interlayer insulating film 22.

A decoder 200 and an output amplifier 210 (see FIG. 6) have high input impedances such that no steady currents flow therein, and therefore in the prior art voltage-dividing resistor circuit, steady currents flow through portions of the resistive element 20 connected between two successive gray-scale reference voltages. A resistance value of a resistor element connected between two successive gray-scale reference voltages is determined by (a length L of a portion of the resistive element 20 between two successive gray-scale reference voltages and serving as a current path) (a width W of the resistive element 20)×(a sheet resistance of the resistive element 20).

In the prior art voltage-dividing resistor circuit, the connections 21 are disposed in a current path of the resistive element 20. As a result, the length, L1, L2 or L3, for example, in FIG. 7, of a portion of the resistive element 20 between two successive gray-scale voltages varies due to manufacturing variations in dimensions of contact holes 300 formed in the interlayer insulating film 22 such that respective resistances of the voltage-dividing resistor circuit vary and consequently, the gray-scale voltages generated in the voltage-dividing resistor circuit vary.

In generating 256 gray-scale voltages, voltage differences between two successive gray-scale voltages are very small, and therefore variations in the gray-scale voltages due to variations in length L of portions of the resistive element 20 connected between two successive gray-scale voltages produce such great influences that the quality of a display image of the liquid crystal display panel 10 is degraded.

Further, a contact area of the connections 21 is limited to such a small area because the connections 21 are disposed in a current path of the resistive element 20 that time delay is caused in a transfer characteristic to the output amplifier 210.

Figure 8:
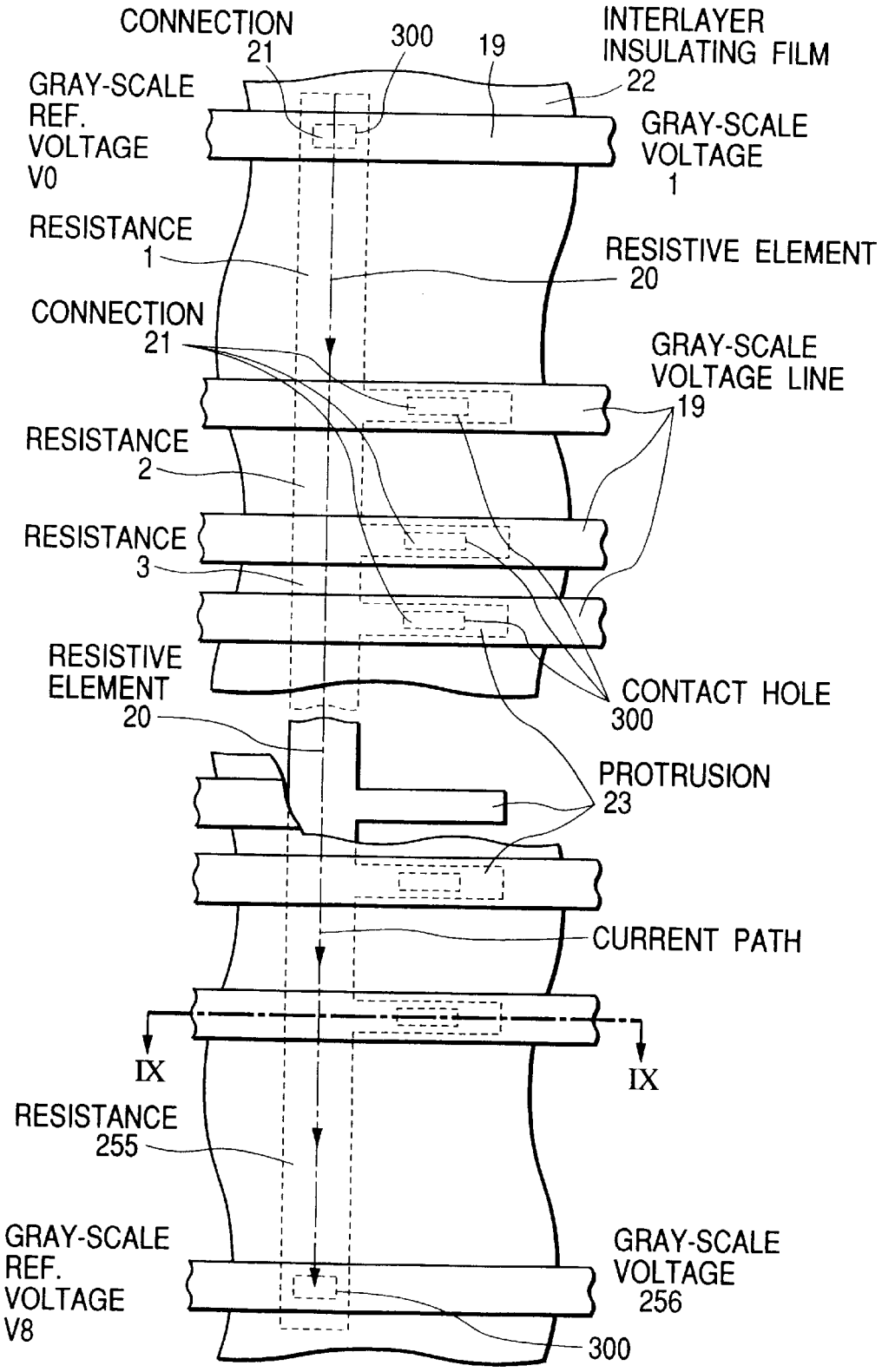
FIG. 8 is a fragmentary plan view illustrating a layout of a gray-scale voltage generating circuit within a semiconductor integrated circuit (a semiconductor chip) in accordance with an embodiment of the present invention.
Figure 9:
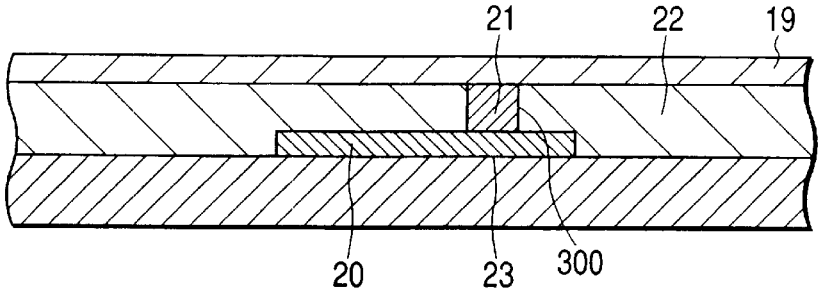
FIG. 9 is a cross-sectional view of the gray-scale voltage generating circuit taken along line IX—IX of FIG. 8.

FIG. 8 is a fragmentary plan view illustrating a layout of a gray-scale voltage generating circuit within a semiconductor integrated circuit (a semiconductor chip) in accordance with the present embodiment of the present invention. FIG. 9 is a cross-sectional view of the gray-scale voltage generating circuit taken along line IX—IX of FIG. 8.

The gray-scale voltage generating circuit of the this embodiment also comprises a plurality of gray-scale voltage lines 19 made of aluminum or the like, a resistive element 20 made of poly-silicon, a diffused resistive film or the like and disposed below the gray-scale voltage lines 19 with an interlayer insulating film 22 interposed therebetween, and a plurality of connections 21 made of aluminum or tungsten, for example, for connecting the gray-scale voltage lines 19 to the resistive element 20 via contact holes 300 formed in the interlayer insulating film 22.

In this embodiment, however, the resistive element 20 is provided with a plurality of protrusions 23, and each of the connections 21 for connecting the gray-scale voltage lines 19 to the resistive element 20 is disposed on a corresponding one of the protrusions 23. That is to say, in this embodiment, the connections 21 are displaced from a current path in the resistive element 20.

In this case, steady currents through the voltage-dividing resistor circuit flow through the shortest path through the resistive element 20, but they do not flow through the protrusions 23 serving as edges of the resistive element 20. Therefore, in this embodiment, no or little variations in length L of portions of the resistive element 20 connected between two successive gray-scale voltages are produced by the manufacturing variations in dimensions of the contact holes 300 formed in the interlayer insulating film 22, and in FIG. 8, resistances of resistors 1, 2, 3, for example, do not vary or vary little in the voltage-dividing resistor circuit.

As a result, the gray-scale voltages generated in the voltage-dividing resistor circuit do not vary, and consequently, the quality of a display image of the liquid crystal display panel 10 is improved.

Further, the contact area of the connections 21 formed in the contact holes 300 is not limited, and therefore, the contact area of the connections 21 can be made larger compared with that in the prior art, and occurrence of time delay in the transfer characteristic to the output amplifier 210 is prevented.

Next, the following explains a bias circuit for supplying a bias current to an amplifier in a drain driver used for a liquid crystal display device in accordance with an embodiment of the present invention.

Figure 10:
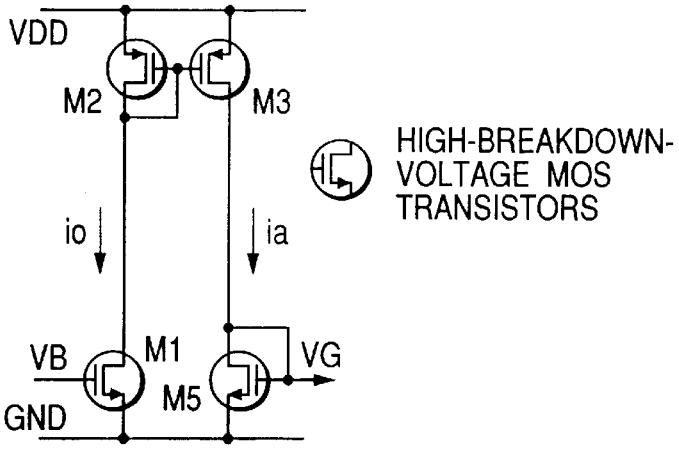
FIG. 10 PRIOR ART
FIG. 10 is an illustration of an example of a basic circuit configuration of a prior art bias circuit.

First, an example of a basic circuit configuration of a prior art bias circuit will be explained with reference to A bias circuit shown in FIG. 10 comprises a pair of p-type MOS transistors (hereinafter referred to merely as PMOS) (M2, M3) forming a current mirror circuit, an n-type MOS transistor. (hereinafter referred to merely as an NMOS) (M1) connected in series with the PMOS (M2), and an NMOS (M5) connected in series with the PMOS (M3).

Here, a bias voltage VB is applied to a gate of the NMOS (M1), and a current (io) caused to flow through the NMOS (M1) by the bias voltage (VB) causes a current (ia) to flow through the NMOS (M5) by the effect of the current mirror circuit formed of the PMOS (M2, M3). A gate voltage (VG) of the NMOS (M5) is applied to a gate of an NMOS forming an internal constant-current source within the output amplifier 210 (see FIG. 6).

The gate and the drain of the NMOS (M5) are connected together such that the NMOS (M5) forms another current mirror circuit with the NMOS forming the internal constant-current source within the output amplifier 210, and therefore a current determined by a current io determined by the bias voltage (VB) flows through the NMOS of the internal constant-current source within the output amplifier 210.

The prior art bias circuit uses a power supply voltage (VDD) for the drain drivers 130 (see FIG. 1) as its power supply voltage, and therefore the prior art bias circuit had to be formed of high-breakdown-voltage MOS transistors (hereinafter referred to merely as high-voltage MOS transistors) because the power supply voltage (VDD) is high.

As described above, in the high-voltage MOS transistors, in general the thickness of the gate insulator oxide is made thick enough to ensure a high withstand voltage (a high breakdown voltage) and a region for relaxing electric fields is necessary, and consequently, variations in threshold voltages and the like of high-voltage MOS transistors are greater than those of low-breakdown-voltage MOS transistors (hereinafter referred to merely as low-voltage MOS transistors). As a result, current values of the currents supplied from the bias circuits to the constant-current sources of the differential amplifiers forming the amplifiers of the drain drivers vary from drain driver 130 (semiconductor chip) to drain driver 130 (semiconductor chip), and there is a problem that there is a possibility that display brightness in a display image of the liquid crystal display panel 10 varies from drain driver 130 to drain driver 130 and the quality of a display image of the liquid crystal display panel 10 is degraded.

To solve this, it is conceivable that a low power supply voltage (VCC) intended for digital signal circuits and used for the drain drivers 130 as a power supply voltage is employed to form a bias circuit using low-voltage MOS transistors. But, to reduce power consumption and electromagnetic interference, a voltage range of digital signals supplied to the drain drivers 130 is made small and consequently, there is a problem that the bias circuit as shown in FIG. 11 cannot produce the state of saturation in each of the MOS transistors and it loses the characteristics of the current mirror circuit.

Next, an example of a basic circuit configuration of a bias circuit in accordance with an embodiment of the present invention will be explained by reference to FIG. 12.

Figure 11:
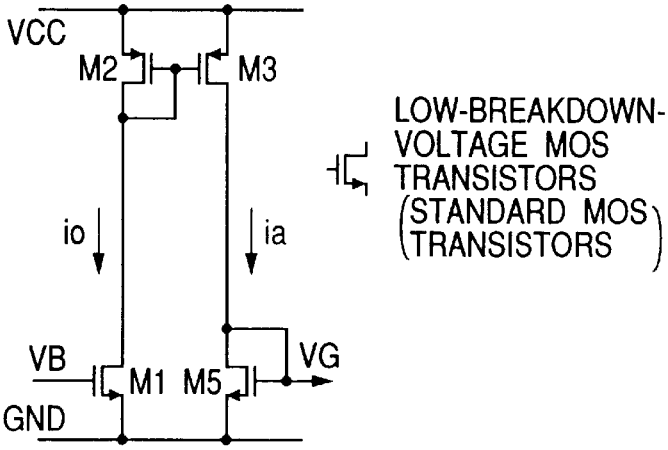
FIG. 11 PRIOR ART
FIG. 11 is an illustration of another example of a basic circuit configuration of a prior art bias circuit.
Figure 12:
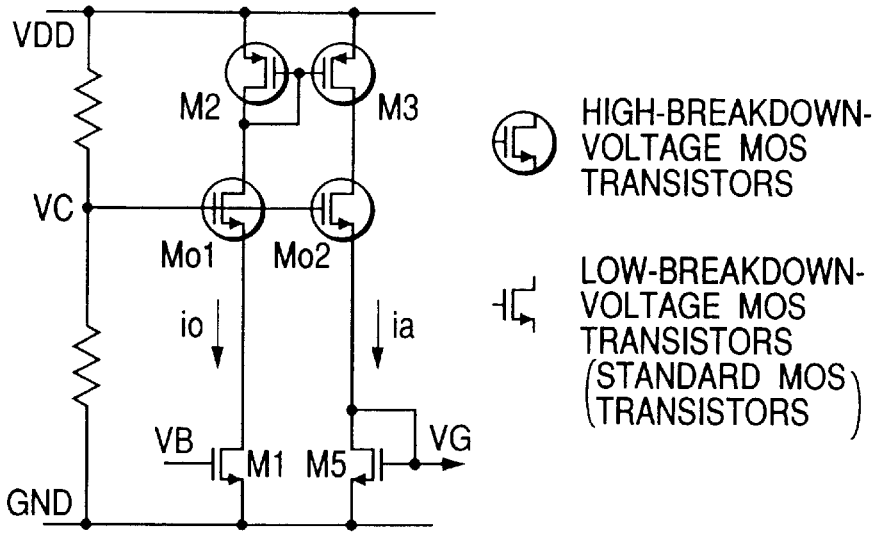
FIG. 12 is an illustration of an example of a basic circuit configuration of a bias circuit in accordance with an embodiment of the present invention.

The bias circuit shown in FIG. 12 differs from that shown in FIG. 11 in that low-voltage MOS transistors are used as the NMOS (M1, M5), a high-voltage NMOS (Mo1) is interposed between the PMOS (M2) and NMOS (M1), and a high-voltage NMOS (Mo2) is interposed between the PMOS (M3) and the NMOS (M5).

A fixed voltage VC divided from a voltage between a power supply voltage GND and the power supply voltage VDD by using voltage-dividing resistors is applied to gates of the NMOS (Mo1, Mo2). Here a drain voltage of the NMOS (M1) (or a source voltage of the NMOS (Mo1)) is approximately the fixed voltage VC−Vth (Mo1), where the Vth (Mo1) is a threshold voltage of the NMOS (Mo1).

If the fixed voltage VC is selected such that Vo−Vth (Mo1) becomes lower than a withstand voltage of the NMOS (M1), supposing Vo is a gate voltage of the NMOS (M5), a low-voltage MOS transistor can be used for the NMOS (M1) for determining a current value.

Generally, a withstand voltage of low-voltage MOS transistors is, smaller than 5 V, and therefore it suffice to select a voltage range of (Vo−Vth(Mo1)) to be smaller than 5 V.

The NMOS (Mo2) is incorporated because a low-voltage-MOS transistor is needed at an output stage of the bias circuit to match a circuit configuration of the output amplifier 210 (see FIG. 6), but if the circuit configuration of the output amplifier 210 does not require a low-voltage MOS transistor, the NMOS (Mo2) is not needed.

Generally, variations in threshold voltage and the like of low-voltage MOS transistors vary little, and therefore in this embodiment, no variations occur in currents supplied from the bias circuit to a constant-current source of a differential amplifier forming the output amplifier 210 and the quality of a display image of the liquid crystal display panel 10 is improved.

Figure 13:
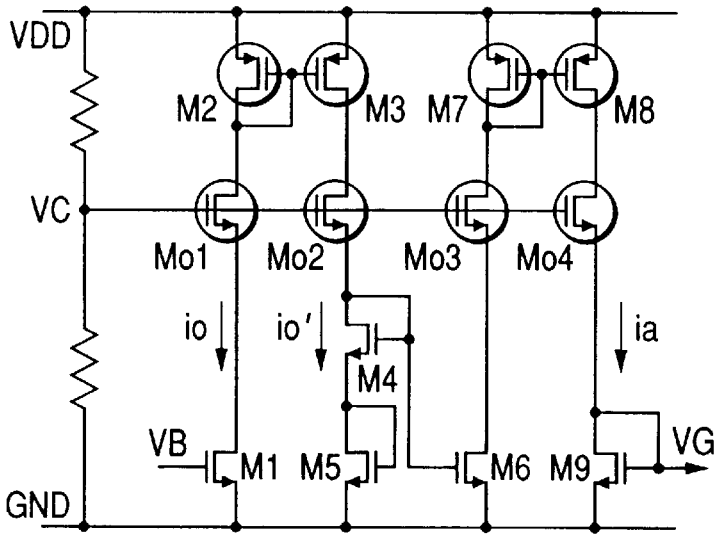
FIG. 13 is an illustration of an example of a basic circuit configuration of a bias circuit in accordance with another embodiment of the present invention.

FIG. 13 is an illustration of an example of a basic circuit configuration of a bias circuit in accordance with another embodiment of the present invention. The bias circuit shown in FIG. 13 is formed of two stages of current mirror circuits. In FIG. 13, suppose that NMOS (M4) and NMOS (M5) are of the same size, a gate voltage of the NMOS (M5) is Vo, a gate voltage of the NMOS (M4) is 2 Vo, all of the NMOS (M1, M4, M6) have the same threshold voltage, then the currents flowing through the NMOS (M1, M4, M6) are represented by the following equations, respectively:

$$io=\beta 1(VB-Vth)/2$$

$$io'=\beta 5(Vo-Vth)/2$$

$$ia=\beta 6(2\ Vo-Vth)/2,$$

where β1, β5 and β6 are constants.

If β1/β5 is selected to be ¼, the current (ia) is not influenced by the threshold voltage of the NMOS (M1, M4, M5).

When the dot-inversion drive method is employed, the output amplifier 210 is formed of a high-voltage amplifier for amplifying positive-polarity gray-scale voltages and a low-voltage amplifier for amplifying negative-polarity gray-scale voltages.

Figure 14:
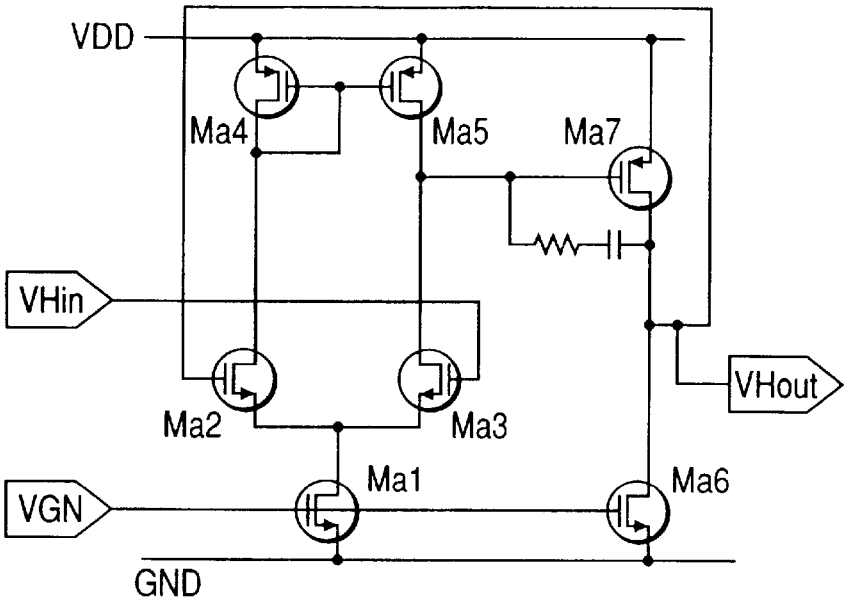
FIG. 14 is an illustration of a basic circuit configuration of a high-voltage amplifier for amplifying positive-polarity gray-scale voltages.
Figure 15:
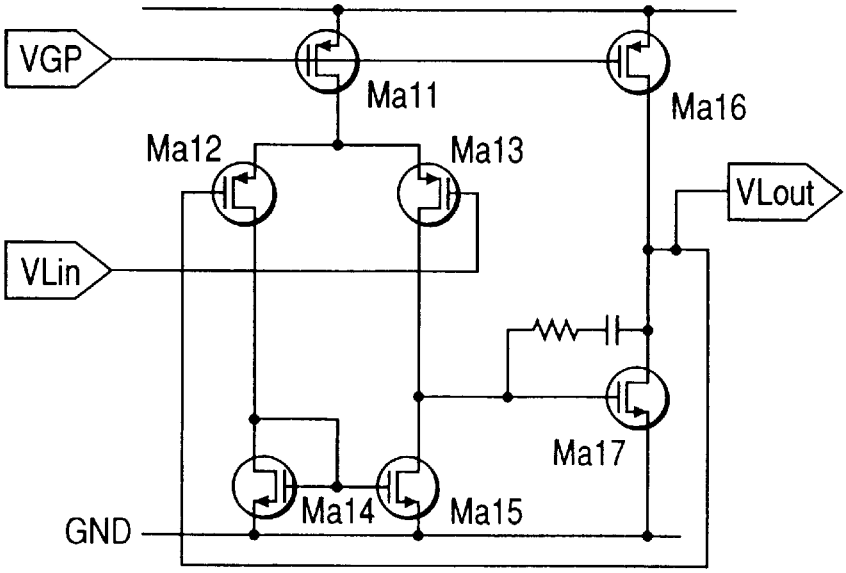
FIG. 15 is an illustration of a basic circuit configuration of a low-voltage amplifier for amplifying negative-polarity gray-scale voltages.

FIG. 14 is an illustration of a basic circuit configuration of a high-voltage amplifier for amplifying positive-polarity gray-scale voltages, and FIG. 15 is an illustration of a basic circuit configuration of a low-voltage amplifier for amplifying negative-polarity gray-scale voltages. Both the amplifiers shown in FIGS. 14 and 15 are formed of differential amplifiers.

Figure 16:
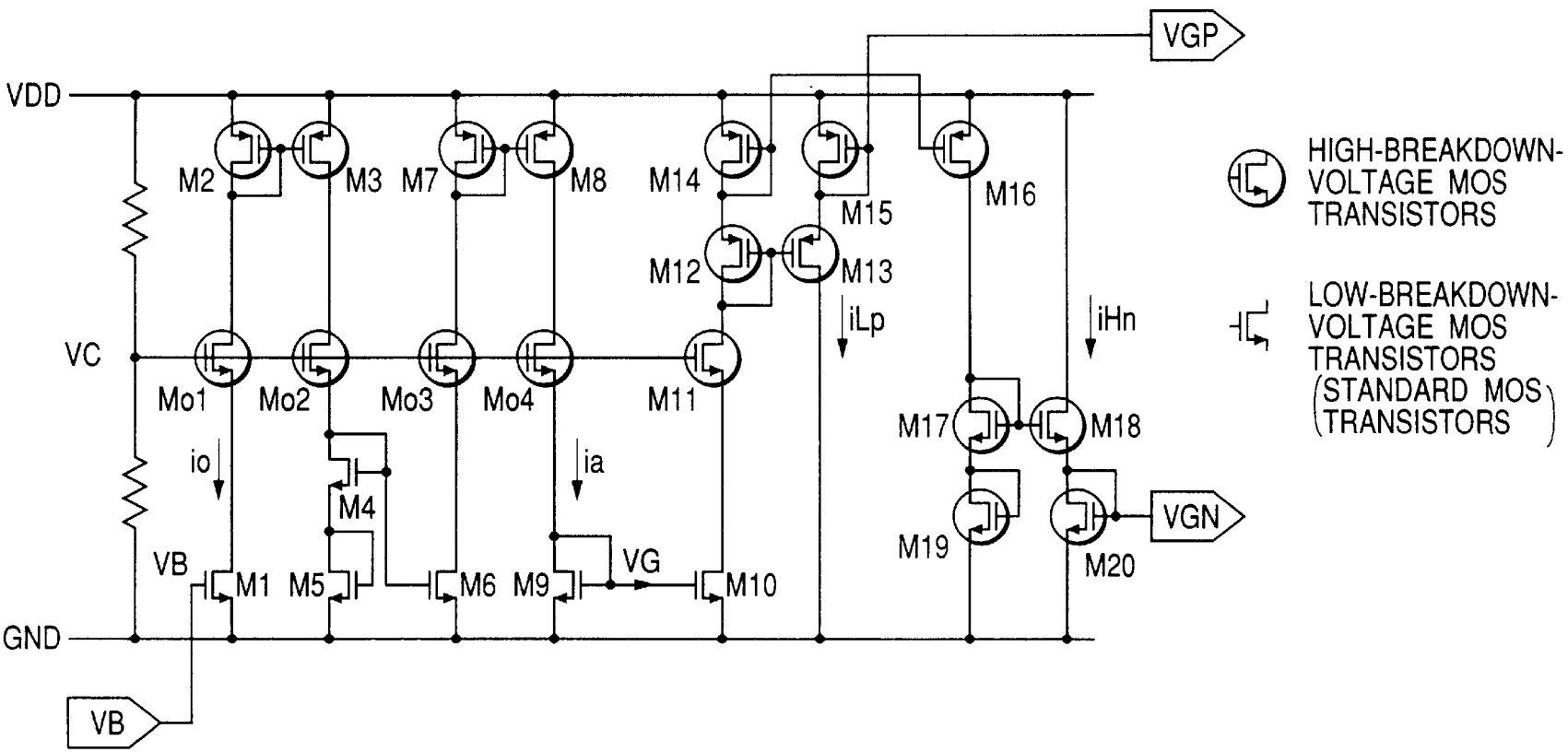
FIG. 16 is an illustration of a bias circuit incorporating the basic bias circuit of FIG. 13 for supplying bias currents to the amplifiers of FIGS. 14 and 15.

FIG. 16 is an illustration of a bias circuit incorporating the basic bias circuit of FIG. 13 for supplying bias currents to the amplifiers of FIGS. 14 and 15.

A bias voltage VGN indicated in FIG. 16 is supplied to the differential amplifier shown in FIG. 14 as its bias voltage, and a bias voltage VGP indicated in FIG. 16 is supplied to the differential amplifier shown in FIG. 15 as its bias voltage. In this bias circuit, the currents iHn, iLp are approximately determined by NMOS (M1, M6), and therefore low-voltage MOS transistors having small variations in characteristics from transistor to transistor are used as the NMOS (M1, M6). In view of this, high-voltage NMOS transistors (Mo1, Mo2, Mo3, Mo4, M11) are added in the respective current lines as shown in FIG. 16.

Figure 17:
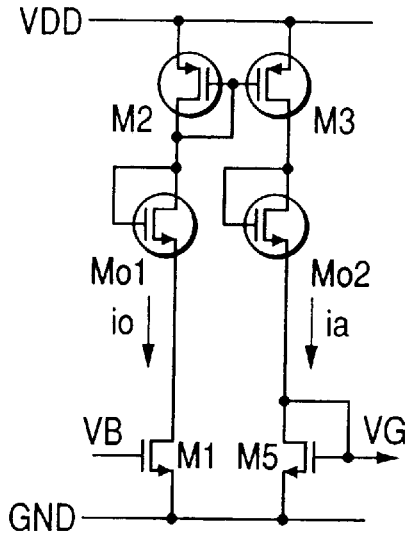
FIG. 17 is an illustration of an example of a basic circuit configuration of a bias circuit in accordance with another embodiment of the present invention.

FIG. 17 is an illustration of an example of a basic circuit configuration of a bias circuit in accordance with another embodiment of the present invention. The bias circuit shown in FIG. 17 differs from that shown in FIG. 13, in that low-voltage MOS transistors are used as NMOS (M1, M5), a diode-connected high-voltage NMOS (Mo1) is connected between PMOS (M2) and NMOS (M1), and a diode-connected high-voltage NMOS (Mo2) is connected between PMOS (M3) and NMOS (M5).

In the bias circuit shown in FIG. 17, a gate voltage of the NMOS (Mo1) is connected to its drain and a drain of the PMOS (M2). A drain voltage Vgs (M2) of the PMOS (M2) is expressed by $$Vgs(M2)=\{(2\cdot Id\cdot L)/(\mu\cdot Co\cdot W)\}^{0.5}+Vth(M2)$$

where Id=a drain current of the PMOS (M2),

L=a length of a gate of the PMOS (M2), $\mu$=mobility in the PMOS (M2),

Co=a capacitance of the gate of the PMOS (M2),

W=a width of the gate of the PMOS (M2), and

Vth (M2)=a threshold voltage of the PMOS (M2).

Therefore, a drain voltage of the,NMOS (M1), that is, a source voltage of the NMOS (Mo1) is Vgs (M2)−Vth (Mo1), where Vth (Mo1) is a threshold voltage of the NMOS (Mo1).

Therefore, if Vgs (M2)−Vth (Mo1) is selected within a withstand voltage of the NMOS (M1), a low-voltage MOS transistor can be used as the NMOS (M1) for determining the current value.

Generally, withstand voltages of low-voltage MOS transistors are equal to or lower than 5 V, and therefore it suffice to select Vo−Vth (Mo1) to be equal to or lower.than 5 V.

Figure 18:
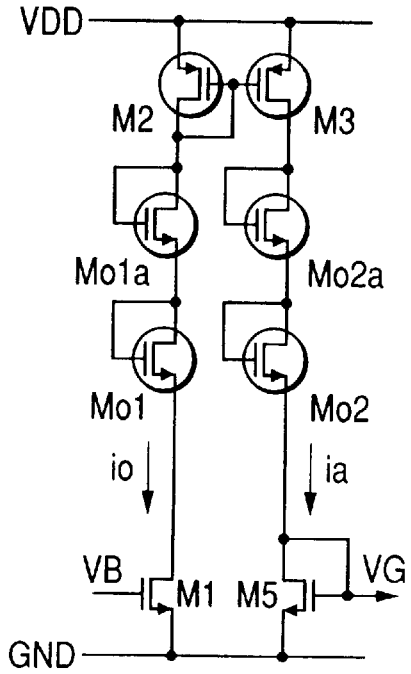
FIG. 18 is an illustration of a circuit having two series-connected NMOS transistors in the bias circuit of FIG. 17.

If the drain voltage of the NMOS (M1), i.e., Vgs (M2)−Vth (Mo1), is excessively large, an adjustment can be made by adding an MOS transistor identical to the NMOS (Mo1) in series. FIG. 18 shows a circuit configuration having the NMOS (Mo1) and an NMOS (Mo1a) connected in series, for example.

Figure 19:
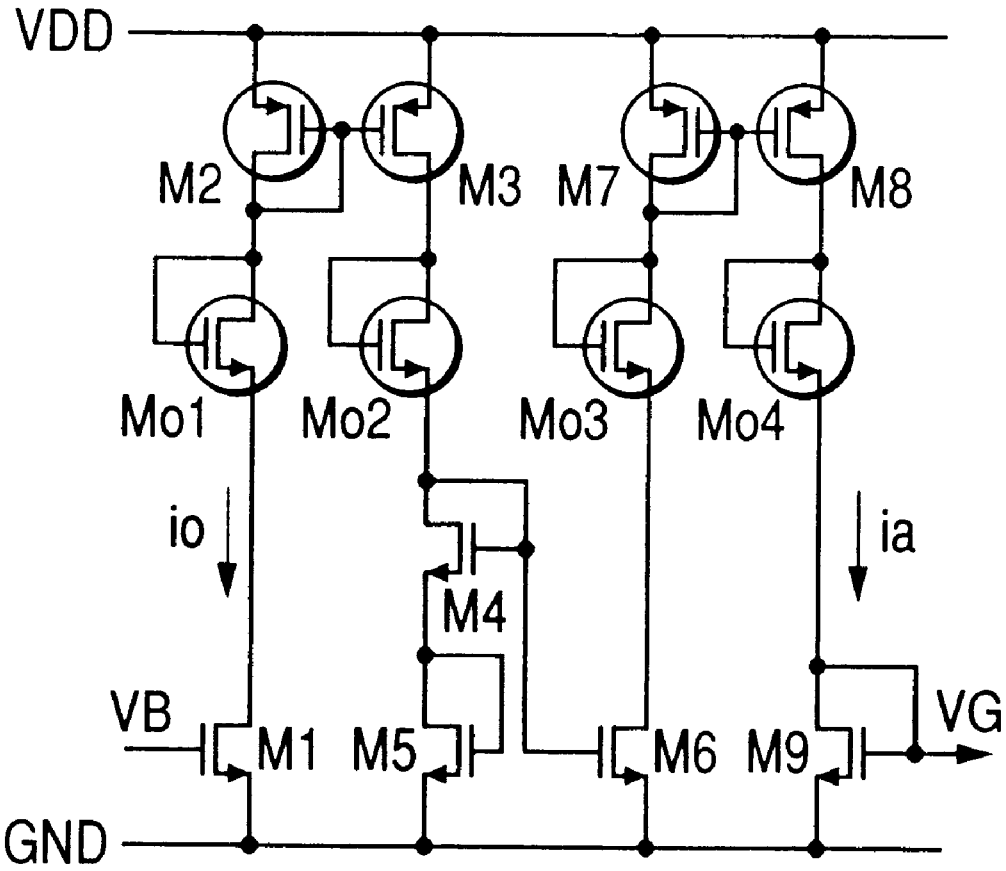
FIG.19 is an illustration of a circuit employing two stages of current mirror-circuits in the bias circuit of FIG. 17.

FIG. 19 shows a circuit configuration forming two stages of current mirror circuits in the bias circuit shown in FIG. 17 as in the case of FIG. 13.

Figure 20:
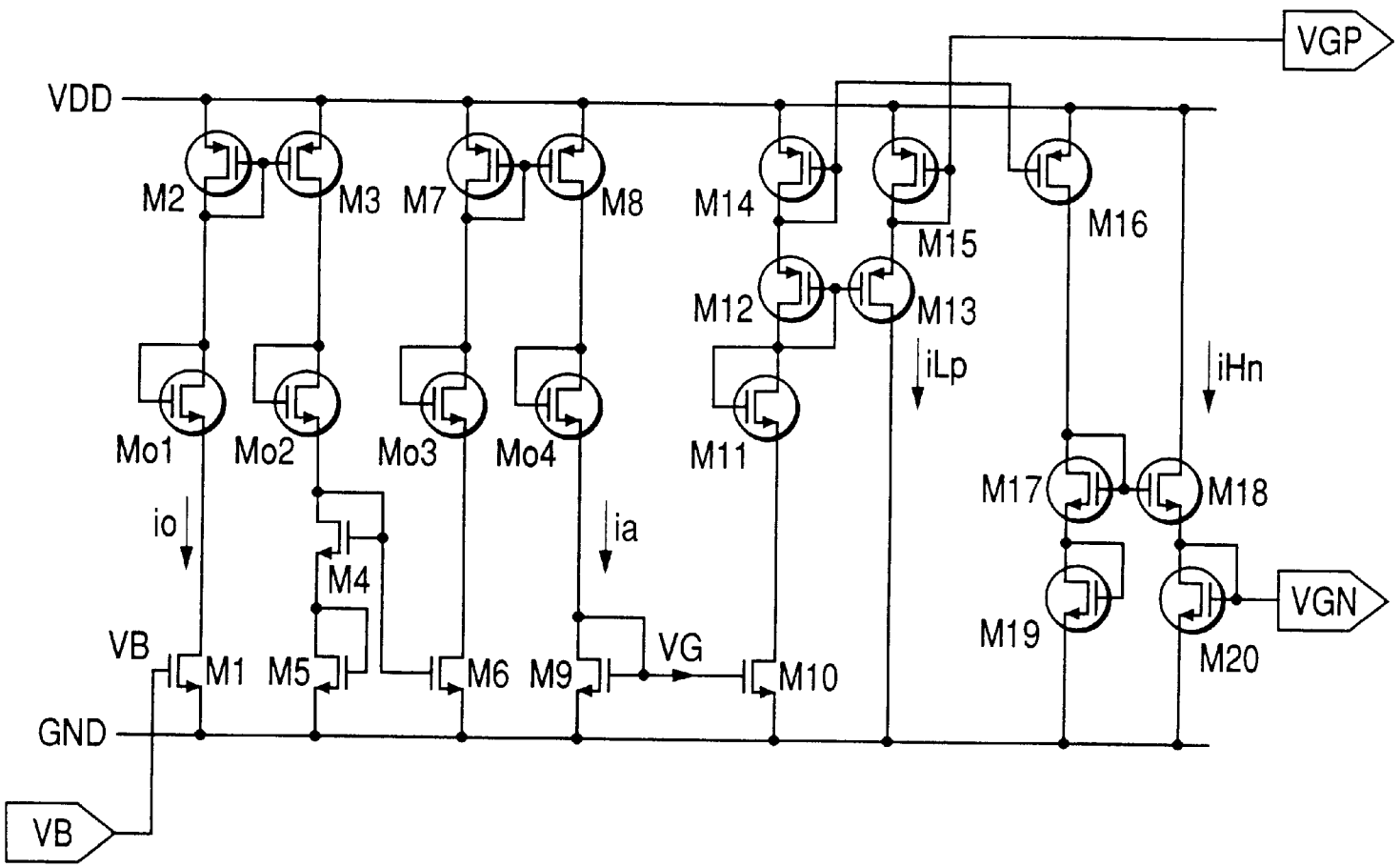
FIG. 20 is an illustration of a bias circuit incorporating the basic bias circuit of FIG. 17 for supplying bias currents to the amplifiers of FIGS. 14 and 15.

FIG. 20 is an illustration of a bias circuit incorporating the basic bias circuit of FIG. 17 for supplying bias currents to the amplifiers of FIGS. 14 and 15. A bias voltage VGN indicated in FIG. 20 is supplied to the differential amplifier of FIG. 14 as the bias voltage, a bias voltage VGP indicated in FIG. 20 is supplied to the differential amplifier as the bias voltage.

Also in this bias circuit, currents iHn, iLp are approximately determined by the NMOS (M1, M6), and therefore low-voltage MOS transistors having small variations in characteristics from transistor to transistor are used as the NMOS (M1, M6). In view of this, low-voltage NMOS transistors (Mo1, Mo2, Mo3, Mo4, M11) are added in the respective current lines.

While the present invention has been explained concretely in connection with the above embodiments of the present invention, the present invention is not limited to the above embodiments and it will be obvious to those skilled in the art that changes and modifications may be made without departing from the nature and spirit of the present invention.

Advantages obtained by the representative inventions disclosed in this specification are summarized as follows:

(1) The quality of a display image of a liquid crystal display panel is improved in the liquid crystal display device in accordance with the present invention.

(2) Occurrence of variations in each gray-scale voltage generated by a gray-scale generating circuit is prevented in the liquid crystal display device in accordance with the present invention.

(3) Low-voltage MOS transistors can be utilized in a bias circuit of the liquid crystal display device in accordance with the present invention, and consequently, currents of constant-current sources of the amplifiers can be made uniform in each video signal line driver.

What is claimed is:

1. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltages to said plurality of video signal lines, said video signal line driver circuit including a gray-scale voltage generating circuit provided with a voltage-dividing resistor circuit for dividing voltages between a plurality of gray-scale reference voltages supplied from an external power supply circuit so as to generate a plurality of gray-scale voltages, a plurality of selector circuits corresponding to said plurality of video signal lines for selecting one gray-scale voltage from among said plurality of gray-scale voltages in accordance with said display data, said voltage-dividing resistor circuit including a resistive element provided with a plurality of intermediate taps for dividing voltages between said plurality of gray-scale reference voltages so as to generate said plurality of gray-scale voltages, a plurality of gray-scale voltage lines corresponding to said plurality of gray-scale voltages, an interlayer insulating film for insulating said plurality of gray-scale lines from said resistive element, and a plurality of connections for electrically connecting each of said plurality of gray-scale voltage lines to a corresponding one of said plurality of intermediate taps through a hole formed in said interlayer insulating film, said plurality of connections being disposed at positions displaced from a current path of a current flowing in said resistive element.

2. A liquid crystal display device according to claim 1, wherein each of said plurality of intermediate taps forms a protruding portion from said resistive element and each of said plurality of connections is disposed on said protruding portion.

3. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltages to said plurality of video signal lines, said video signal line driver circuit including a gray-scale voltage generating circuit provided with a voltage-dividing resistor circuit for dividing voltages between a plurality of gray-scale reference voltages supplied from an external power supply circuit so as to generate a plurality of gray-scale voltages, a plurality of selector circuits corresponding to said plurality of video signal lines for selecting one gray-scale voltage from among said plurality of gray-scale voltages in accordance with said display data, said voltage-dividing resistor circuit including a resistive element provided with a plurality of intermediate taps for dividing voltages between said plurality of gray-scale reference voltages so as to generate said plurality of gray-scale voltages, a plurality of gray-scale voltage lines corresponding to said plurality of gray-scale voltages, an interlayer insulating film for insulating said plurality of gray-scale lines from said resistive element, and a plurality of connections for electrically connecting each of said plurality of gray-scale voltage lines to a corresponding one of said plurality of intermediate taps through a hole formed in said interlayer insulating film, each of said plurality of intermediate taps forming a portion protruding in a direction of extension of said plurality of gray-scale voltage lines, from said resistive element and each of said plurality of connections being disposed on said protruding portion.

4. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including:

a plurality, of amplifiers corresponding to said plurality of video signal lines, each of said plurality of amplifiers outputting said video signal voltage to a corresponding one of said plurality of video signal lines, and a bias circuit including a current mirror circuit for controlling a current in a constant-current source in each of said plurality of amplifiers, said current mirror circuit including, between a first power supply voltage line supplied with a first reference power supply voltage and a second power supply voltage line supplied with a second reference power supply voltage:

a first transistor element of a first conductivity type and having a low breakdown voltage, a second transistor element of a second conductivity type and having a breakdown voltage higher than said low breakdown voltage, said second transistor element being connected in series with said first transistor element, and at least one third transistor element of said first conductivity type, having a breakdown voltage higher than said low breakdown voltage, said at least one third transistor element being connected between said first transistor element and said second transistor element and having a fixed bias voltage applied to a control electrode thereof, said fixed bias voltage being between said first and second reference power supply voltages.

5. A liquid crystal display device according to claim 4, wherein said fixed bias voltage is provided by a voltage dividing circuit dividing a voltage between said first and second reference power supply voltages.

6. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including:

a plurality of amplifiers corresponding to said plurality of video signal lines, each of said plurality of amplifiers outputting said video signal voltage to a corresponding one of said plurality of video signal lines, and a bias circuit including a current mirror circuit for controlling a current in a constant-current source in each of said plurality of amplifiers, said current mirror circuit including, between a first power supply voltage line supplied with a first reference power supply voltage and a second power supply voltage line supplied with a second reference power supply voltage:

a first transistor element of a first conductivity type and having a low breakdown voltage, a second transistor element of a second conductivity type and having a breakdown voltage higher than said low breakdown voltage, said second transistor element being connected in series with said first transistor element, and at least one third transistor element of said first conductivity type, having a breakdown voltage higher than said low breakdown voltage, said at least one third transistor element being connected between said first transistor element and said second transistor element and having a control electrode thereof connected to a terminal thereof connected to said second transistor element.

7. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including a plurality of amplifiers corresponding to said plurality of video signal lines, each of said-plurality of amplifiers outputting said video signal voltage to a corresponding one of said plurality of video signal lines, and, a bias circuit for controlling a current in a constant-current source in each of said plurality of amplifiers, said bias-circuit including (a) a first series combination comprising: a first transistor element of a first conductivity type and having a first low breakdown voltage; a second transistor element of a second conductivity type and having a breakdown voltage higher than said first low breakdown voltage, said second transistor element being connected in series with said first transistor element; and at least one third transistor element of said first conductivity type and having a breakdown voltage higher than said first low breakdown voltage, said at least one third transistor element being connected between said first transistor element and said second transistor element; a terminal of said second transistor element connected to said at least one third transistor element being connected to a control electrode of said second transistor element, and a control electrode of said first transistor element being supplied with a bias voltage;

(b) a second series combination comprising:

a fourth transistor element of said first conductivity type and having a second low breakdown voltage;

a fifth transistor element of said second conductivity type and having a breakdown voltage higher than said second low breakdown voltage, said fifth transistor element being connected in series with said fourth transistor element; and at least one sixth transistor element of said first conductivity type and having a breakdown voltage higher than said second low breakdown voltage, said at least one sixth transistor element being connected between said fourth transistor element and said fifth transistor element;

a control electrode of said fifth transistor element being connected to said control electrode of said second transistor element, a terminal of said fourth transistor element connected to said at least one sixth transistor element being connected to a control electrode of said fourth transistor element, and a control electrode of said fourth transistor element being configured so as to provide an output;

wherein a parallel combination of said first series combination and said second series combination is connected between a first power supply voltage line supplied with a first reference power supply voltage and a second power supply voltage line supplied with a second reference power supply voltage, and a voltage intermediate between said first and second reference power supply voltages is applied to control electrodes of said at least one third transistor element and said at least one sixth transistor element.

8. A liquid crystal display device comprising a liquid crystal display-element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including a plurality of amplifiers corresponding to said plurality of video signal lines, each of said plurality of amplifiers outputting said video signal voltage to a corresponding one of said plurality of video signal lines, and a bias circuit for controlling a current in a constant-current source in each of said plurality of amplifiers, said bias circuit including (a) a first series combination comprising:

a first transistor element of a first conductivity type and having a first low breakdown voltage;

a second transistor element of a second conductivity type and having a breakdown voltage higher than said first low breakdown voltage, said second transistor element being connected in series with said first transistor element; and at least one third transistor element of said first conductivity type and having a breakdown voltage higher than said first low breakdown voltage, said at least one third transistor element being connected between said first transistor element and said second transistor element;

a terminal of said second transistor element connected to said at least one third transistor element being connected to a control electrode of said second transistor element, and a control electrode of said first transistor element being supplied with a bias voltage;

(b) a second series combination comprising:

a fourth transistor element of said first conductivity type and having a second low breakdown voltage;

a fifth transistor element of said second conductivity type and having a breakdown voltage higher than said second low breakdown voltage, said fifth transistor element being connected in series with said fourth transistor element; and at least one sixth transistor element of said first conductivity type and having a breakdown voltage higher than said second low breakdown voltage, said at least one sixth transistor element being connected between said fourth transistor element and said fifth transistor element;

a control electrode of said fifth transistor element being connected to said control electrode of said second transistor element, a terminal of said fourth transistor element connected to said at least one sixth transistor element being connected to a control electrode of said fourth transistor element, and a control electrode of said fourth transistor element being configured so as to provide an output;

wherein a parallel combination of said first series combination and said second series combination is connected between a first power supply voltage line supplied with a first reference power supply voltage and a second power supply voltage line supplied with a second reference power supply voltage, a control electrode of said at least one third transistor element is connected to a terminal of said at least one third transistor element connected to said second transistor element, and a control electrode of said at least one sixth transistor element is connected to a terminal of said at least one sixth transistor element connected to said fifth transistor element.

9. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including:

a plurality, of amplifiers corresponding to said plurality of video signal lines, each of said plurality of amplifiers outputting said video signal voltage to a corresponding one of said plurality of video signal lines, and a bias circuit including a current mirror circuit for controlling a current in a constant-current source in each of said plurality of amplifiers, said current mirror circuit including, between a first power supply voltage line supplied with a first reference power supply voltage and a second power supply voltage line supplied with a second reference power supply voltage, means for preventing variations in current produced by the bias circuit, said means comprising:

a first transistor element of a first conductivity type and having a low breakdown voltage, a second transistor element of a second conductivity type and having a breakdown voltage higher than said low breakdown voltage, said second transistor element being connected in series with said first transistor element, and at least one third transistor element of said first conductivity type, having a breakdown voltage higher than said low breakdown voltage, said at least one third transistor element being connected between said first transistor element and said second transistor element and having a fixed bias voltage applied to a control electrode thereof, said fixed bias voltage being between said first and second reference power supply voltages.

10. A liquid crystal display device according to claim 9, wherein said fixed bias voltage is provided by a voltage dividing circuit dividing a voltage between said first and second reference power supply voltages.

11. A liquid crystal display device comprising a liquid crystal display element having a plurality of pixels arranged in a matrix and a plurality of video signal lines for applying a video signal voltage to each of said plurality of pixels in accordance with a display data, and a video signal line driver circuit for supplying said video signal voltage to said plurality of video signal lines, said video signal line driver circuit including:

a plurality of amplifiers corresponding to said plurality of video signal lines, each of said plurality of amplifiers outputting said video signal voltage to a corresponding one of said plurality of video signal lines, and a bias circuit including a current mirror circuit for controlling a current in a constant-current source in each of said plurality of amplifiers, said current mirror circuit including, between a first power supply voltage line supplied with a first reference power supply voltage and a second power supply voltage line supplied with a second reference power supply voltage, means for preventing variations in current produced by the bias circuit, said means comprising:

a first transistor element of a first conductivity type and having a low breakdown voltage, a second transistor element of a second conductivity type and having a breakdown voltage higher than said low breakdown voltage, said second transistor element being connected in series with said first transistor element, and at least one third transistor element of said first conductivity type, having a breakdown voltage higher than said low breakdown voltage, said at least one third transistor element being connected between said first transistor element and said second transistor element and having a control electrode thereof connected to a terminal thereof connected to said second transistor element.

* * * * *